US005319432A

United States Patent [19]

Akashi et al.

[11] Patent Number: 5,319,432

[45] Date of Patent: Jun. 7, 1994

[54] SHEET DELIVERY MECHANISM

[75] Inventors: Masakatsu Akashi, Kakogawa; Masahiko Kobayashi, Ikoma; Junichi Hirobe, Kadoma; Tsutomu Sugaya, Hirakata, all of Japan

[73] Assignee: Mita Industrial Co., Ltd., Japan

[21] Appl. No.: 885,967

[22] Filed: May 20, 1992

[30] Foreign Application Priority Data

| | | | |
|---|---|---|---|
| May 23, 1991 | [JP] | Japan | 3-118850 |
| Sep. 5, 1991 | [JP] | Japan | 3-226114 |
| Sep. 5, 1991 | [JP] | Japan | 3-226115 |
| Sep. 5, 1991 | [JP] | Japan | 3-226116 |

[51] Int. Cl.[5] ..... G03G 21/00

[52] U.S. Cl. ..... 355/308; 271/229; 271/245; 271/256

[58] Field of Search ..... 355/208, 308, 309, 321; 271/3.1, 4, 9, 118, 229, 245, 258, 264, 265, 256

[56] References Cited

U.S. PATENT DOCUMENTS

| | | | |
|---|---|---|---|
| 3,930,725 | 1/1976 | Jones et al. | 271/9 X |
| 4,017,172 | 4/1977 | Lynch | 271/109 X |
| 4,202,621 | 5/1980 | Yoshimura et al. . | |
| 4,426,150 | 1/1984 | Matsumoto et al. . | |
| 4,903,047 | 2/1990 | Hatanaka | 355/312 X |
| 4,958,199 | 9/1990 | Yamashita et al. | 355/317 |
| 5,122,841 | 6/1992 | Sasaki | 355/321 |

FOREIGN PATENT DOCUMENTS

| | | |
|---|---|---|
| 055550 | 7/1982 | European Pat. Off. . |
| 2059883 | 1/1972 | Fed. Rep. of Germany . |

*Primary Examiner*—Leo P. Picard
*Assistant Examiner*—Christopher Horgan
*Attorney, Agent, or Firm*—Beveridge, DeGrandi, Weilacher & Young

[57] ABSTRACT

A sheet delivery mechanism includes a pair of delivery rollers which deliver a sheet along a sheet delivery passage of a sheet treatment apparatus for predeterminately treating the sheet, a sheet halting member for halting the sheet, and a pinching force adjusting member. The pinching force adjusting member adjusts the delivery rollers to place them into a first state where the sheet pinching force of the delivery rollers is relatively small so that the delivery rollers can slip on the halted sheet and into a second state where the sheet pinching force is relatively great so that the sheet can be delivered in the case where a sheet halt is released for delivery.

41 Claims, 24 Drawing Sheets

SHEET DELIVERY MECHANISM

BACKGROUND OF THE INVENTION

The present invention relates to a sheet delivery mechanism, and more particularly to a sheet delivery mechanism suitable for an image forming apparatus such as a copying machine, a facsimile or a page printer, and a sheet treatment apparatus such as an automated hole punch for treating a sheet.

The sheet delivery mechanism of this type is always provided in a sheet treatment apparatus and delivers a sheet correspondingly to sheet treatment operation.

For example, an electrophotographic image forming apparatus has a structure in which a document image is exposed onto a photoreceptor to form an electrostatic latent image, the electrostatic latent image is developed into a toner image, and the toner image is transferred onto a sheet so as to obtain copy. Such an electrophotographic image forming apparatus comprises a pair of delivery rollers for delivering a sheet to a photoreceptor, and a resist device for delivering the sheet at a timing corresponding to an image position on the photoreceptor after delivery is started by the delivery rollers. The resist device has the very important function of delivering the sheet at a predetermined timing so as to move the sheet into the transferring position of the document image on the photoreceptor.

Referring to a timing control method of the sheet delivery mechanism described above, the phase of a rotator which rotates synchronously with the photoreceptor is detected by a microswitch, and a solenoid of a clutch of each sheet delivery means is operated according to a signal generated by the microswitch.

According to the above-mentioned method, however, there is variation in response time until a signal is generated by the microswitch and the solenoid is actually operated. Consequently, it cannot be expected that sheet delivery operation is carried out at an accurate timing. In case of a thin sheet, wrinkles may occur due to the pressure welding force of the delivery rollers. In case of a thick sheet, delivery may not be carried out in relation to an angle of insertion of nip members of the delivery rollers.

To cope with the above-mentioned drawbacks, there has been proposed the prior art shown in FIG. 26 (Japanese Patent Publication No. 7462/1990).

According to the prior art, a stopper 1032 is provided on the downstream side of sheet delivery rollers 1007*a* and 1007*b*. The stopper 1032 halts a sheet in a first sheet delivery state (shown by a solid line in FIG. 26) and releases a sheet halt in a second sheet delivery state (shown by a two-dotted line 1032*a* in FIG. 26).

A link mechanism R is provided between a document table 1001 and the stopper 1032 in order to transfer the stopper 1032 from the first sheet delivery state to the second sheet delivery state.

The link mechanism R includes a pair of cams 1019*b* and 1019*c*, a projection for drive 1020, a first arm 1022, a first pivot 1023, a second arm 1028, a second pivot 1029, a pair of forks 1031*a* and 1031*b*, and a tension spring 1033. The cams 1019*b* and 1019*c* are provided in a bottom trench 1019*a* on the document table 1001. The projection 1020 is driven by the cams 1019*b* and 1019*c*. The first arm 1022 interlocks with the projection 1020. The first pivot 1023 pivots the first arm 1022. The second arm 1028 interlocks with the first arm 1022 when the first arm 1022 is driven around the first pivot 1023.

The second pivot 1029 pivots the second arm 1028. The forks 1031*a* and 1031*b* are integrally formed with the second arm 1028 and causes the stopper 1032 to fluctuate when the second arm 1028 is driven around the second pivot 1029. The tension spring 1033 urges the projection 1020 upward through the first arm 1022.

In FIG. 26, when a main switch is turned on, the document table 1001 moves to a document exposure position. When a copy button is pressed, the document table 1001 starts to move from a home position to expose a document.

In the first sheet delivery state, a sheet is delivered by the delivery rollers 1007*a* and 1007*b*, and the tip of the sheet comes in contact with the stopper 1032 and is aligned in parallel with an axis of a photoreceptor drum 1003. In this state, upper and lower rollers 1007*a* and 1007*b* slip on the sheet.

When the cams 1019*b* and 1019*c* press down the projection 1020 at a predetermined timing, the first and second arms 1022 and 1028 rotate around the corresponding pivots 1023 and 1029 according to the operation of the projection 1020. As a result, an apparatus shown in FIG. 26 is transferred from the first sheet delivery state to the second sheet delivery state. Thereby, the forks 1031*a* and 1031*b* of the second arm 1028 fall to lower the stopper 1032. Consequently, a delivery passage 1036 is opened. When the delivery passage 1036 is opened, the sheet is delivered to the photoreceptor drum 1003 by the sheet delivery rollers 1007*a* and 1007*b* again. When the rear end of the sheet passes through the stopper 1032 and the projection 1020 then moves from the cams 1019*b* and 1019*c* to the bottom trench 1019*a* by the urging force of the tension spring 1033, the stopper 1032 is also driven upward through the link mechanism R. Consequently, the delivery passage 1036 is closed again, so that the apparatus returns to the first sheet delivery state.

Referring to the sheet delivery mechanism according to the prior art, it is required that the delivery rollers 1007*a* and 1007*b* slip on the sheet in order to stop sheet delivery when the sheet comes in contact with the stopper 1032 in the first delivery state. Consequently, the pressure welding force between the delivery rollers 1007*a* and 1007*b* cannot be made great. For this reason, the sheet is unstably gripped by the delivery rollers 1007*a* and 1007*b* so that poor delivery may easily occur, for example, the sheet is obliquely supplied to the photoreceptor drum 1003. Thus, it is required that a pair of auxiliary delivery rollers having greater pressure welding force are further provided between the stopper 1032 and the photoreceptor drum 1003. As a result, production costs are increased.

As disclosed in the above-mentioned prior art, the start position of the sheet is controlled by the stopper 1032. Consequently, when there is variation in sheet delivery state precision of the stopper 1032 and delivery rollers 1007*a* and 1007*b*, and that of the stopper 1032 and photoreceptor drum 1003, the start position of the sheet for the photoreceptor drum 1003 varies. For this reason, it is impossible to deliver the sheet at a timing corresponding to an image position on the photoreceptor drum 1003. As a result, an image tip position on the sheet is shifted so that an image is made poor.

In the case where the apparatus is stopped due to clogging or the like, the delivery rollers 1007*a* and 1007*b* cannot synchronize with the photoreceptor drum 1003 when the apparatus is reactivated without returning the document table 1001 to the home position and the sheet is inserted. Consequently, a timing deviates so that copy failure may be caused.

In consideration of the above-mentioned problems, it is an object of the present invention to provide a sheet delivery mechanism having a simple structure which can be adopted in a sheet treatment apparatus, capable of causing a sheet to smoothly stand by when the sheet to be delivered is halted, and of surely delivering the sheet when a sheet halt is released for delivery.

It is another object of the present invention to provide a sheet delivery mechanism capable of preventing a sheet from being delivered so as not to mistreat the sheet even if the sheet is inserted when a sheet treatment apparatus is reactivated in a state where its working member does not return to an idling condition.

It is yet another object of the present invention to provide a sheet delivery mechanism which does not need a pair of auxiliary delivery rollers between a stopper and a photoreceptor and can reduce production costs in the case where the sheet treatment apparatus is an image forming apparatus.

It is a further object of the present invention to provide a sheet delivery mechanism capable of holding a sheet with high precision by preventing the sheet delivery state relationship between a sheet halting member and a photoreceptor from varying and of delivering the sheet to the photoreceptor at a predetermined timing so that an image tip position on the sheet can be prevented from being shifted in the case where the sheet treatment apparatus is an image forming apparatus.

SUMMARY OF THE INVENTION

A sheet delivery mechanism according to a first aspect of the present invention comprises:

(a) a pair of delivery rollers which include a drive roller and a roller driven with the drive roller to thereby hold a sheet therebetween such that one of the rollers can separate from the other roller and deliver the sheet along a sheet delivery passage of a sheet treatment apparatus for predeterminately treating the sheet;

(b) sheet halting means for halting the sheet by coming in contact therewith a tip of the sheet delivered by the delivery rollers; and (c) pinching force adjusting means for normally adjusting the delivery rollers into a first state where the sheet pinching force of the delivery rollers is relatively small so that the delivery rollers can slip on the halted sheet and into a second state where the sheet pinching force is relatively great so that the sheet can surely be delivered in the case where a sheet halt is released for delivery.

From this aspect, the pressure welding force of the delivery rollers is reduced by the pinching force adjusting means in the first state, so that the delivery rollers can slip on the sheet. Consequently, the sheet halting means can cause the sheet to smoothly stand by. In the second state, the pressure welding force of the delivery rollers can be increased so that the sheet can surely be delivered.

Accordingly, it is not required that a pair of auxiliary delivery rollers are provided on the downstream side of the delivery rollers. Consequently, the structure of an apparatus can be made simpler. Furthermore, production costs can be reduced.

A sheet delivery mechanism according to a second aspect of the present invention comprises;

(a) a pair of delivery rollers for holding a sheet therebetween and introducing the sheet into a sheet delivery passage of a sheet treatment apparatus for predeterminately treating the sheet;

(b) a sheet guide for guiding the sheet delivered by the delivery rollers;

(c) supporting means for supporting the sheet guide such that the sheet guide can be switched between a halting attitude for preventing the sheet from being delivered and a delivery allowance attitude for allowing the sheet to be delivered;

(d) switching means for switching the attitudes of the sheet guide; and (e) sheet halting means for halting the sheet by coming in contact therewith a tip of the sheet guided by the sheet guide at the halting attitude, and the sheet halting means being integrally formed on a passage forming member which forms a sheet delivery passage.

From this aspect, when the sheet is delivered by the delivery rollers, the tip of the sheet is engaged with the sheet halting means which is integrally formed with the passage forming member. Consequently, a stand-by state is temporarily brought. Thus, the start position of the sheet is not controlled by a resist plate but by the sheet halting means which is integrally formed with the passage forming member. Consequently, the start position of the sheet is determined only by the working precision of the passage forming member. Accordingly, the start position of the sheet can be prevented from varying. Furthermore, the precision in engagement position of the sheet can be enhanced.

A sheet delivery mechanism according to a third aspect of the present invention comprises;

(a) a pair of delivery rollers for holding a sheet therebetween and delivering the sheet to a sheet delivery passage of a sheet treatment apparatus to predeterminately treat the sheet, the rollers including a working member which returns from an idling condition to the idling condition through predetermined sheet treating process;

(b) a sheet guide for guiding the sheet delivered by the delivery rollers;

(c) supporting means for supporting the sheet guide such that the sheet guide can be switched between a halting attitude for preventing the sheet from being delivered and a delivery allowance attitude for allowing the sheet to be delivered;

(d) switching means for switching the attitudes of the sheet guide by means of interlocking means included therein, the interlocking means causing the sheet guide to interlock with the working member; and (e) drive preventing means provided on the sheet guide for preventing the delivery rollers from being driven when the sheet treatment apparatus is reactivated in a state where the working member does not return to the idling condition.

From this aspect, in the case where the sheet treatment apparatus is stopped and then reactivated in a state where it does not return to the idling condition, the drive preventing means blocks a delivery passage from a sheet feeder to the delivery rollers so that the sheet is prevented from being inserted on the upstream side of the delivery rollers. Consequently, a sheet treatment timing does not deviate so that working errors can be prevented from being caused.

BRIEF DESCRIPTION OF THE DRAWINGS

Further characteristics, objects and effects of the present invention will be more apparent from the following detailed description with reference to the attached drawings in which the same members have the same reference designations.

DESCRIPTION OF THE PREFERRED EMBODIMENTS

Figure 1:
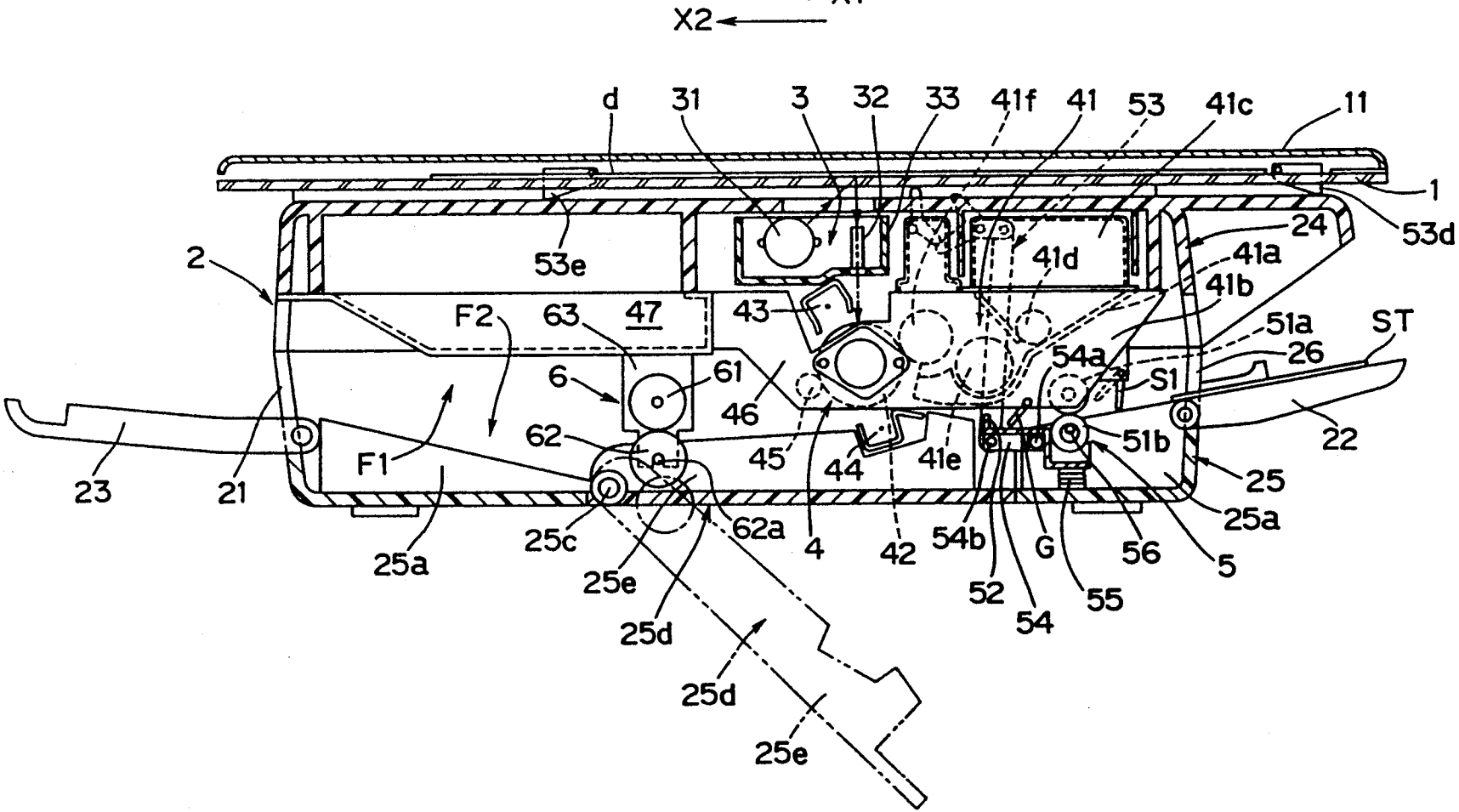
FIG. 1 is a section view of a copying machine as a sheet treatment apparatus which adopts the present invention.

FIG. 1 is a section view showing the inner structure of a copying machine as a sheet treatment apparatus which adopts a sheet delivery mechanism according to an embodiment of the present invention.

Sheet Treatment Apparatus

With reference to FIG. 1, the copying machine comprises a body 2 having a document table 1 as a working member on its top portion. The document table 1 is comprised of a transparent glass plate. The copying machine is a so-called table movement type apparatus in which the document table 1 laterally reciprocates to illuminate and scan a document d placed thereon in FIG. 1.

Document Table (Working Member)

More specifically, when image forming treatment is started, the document table 1 once retreats to the left as shown by an arrow X2 in FIG. 1 so as to illuminate and scan the document d in an idling condition, i.e., a home position state shown in FIG. 1 (First Step). When a quantity of movement reaches a predetermined maximum value, the document table 1 advances as shown by an arrow Xl (Second Step). At the time of advance, i.e., the second step, the document d is illuminated and scanned. When the advance is terminated, the document table 1 retreats as shown by the arrow X2 (Third Step) and returns to a home position shown in FIG. 1. Above the document table 1 is provided a document cover 1 which can rotatably be opened. The document cover 11 covers the document d placed on the document table 1.

Inner Structure of Sheet Treatment Apparatus

Figure 2:
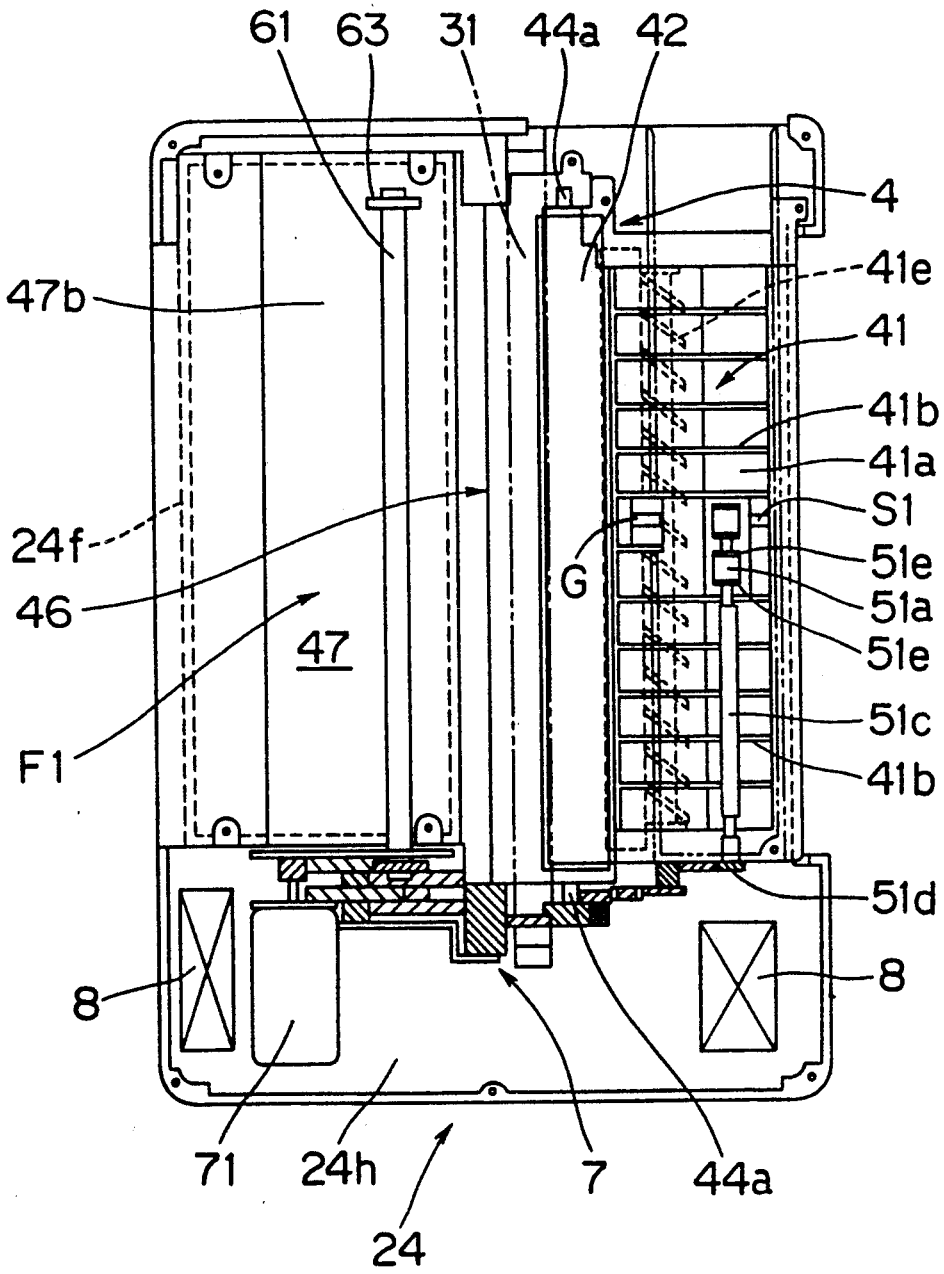
FIG. 2 is a bottom view of an upper casing forming a copying machine body.

The body 2 includes functional parts such as an optical system 3, image forming means 4, a sheet delivery mechanism 5, an image fixing device 6, a drive system 7 (see FIG. 2), and electrical equipment 8 (see FIG. 2). The optical system 3 illuminates and scans the document d moved by the document table 1. The image forming means 4 develops an illuminated and scanned document image into a toner image and then transfers the toner image onto a sheet ST. The sheet delivery mechanism 5 delivers the sheet ST from a paper feeder 26 of the body 2 along a sheet delivery passage of the body 2. The image fixing device 6 fixes the toner image transferred onto the sheet ST by holding and heating the same between a heat roller 61 and a pressure roller 62. The drive system 7 drives the document table 1, the image forming means 4 and the sheet delivery mechanism 5. The electrical equipment 8 has a control circuit for controlling their driving, and the like.

Optical System

The optical system 3 has a case 33 in which a fluorescent lamp 31, a lens 32 and the like are provided. The fluorescent lamp 31 illuminates the document d. The lens 32 guides light reflected by the document d to a photoreceptor drum 42.

Image Forming Means

The image forming means 4 has a photoreceptor drum 42 as a working member, an electrostatic charger 43, a developing device 41, a transferring charger 44, and a cleaner 45. The electrostatic charger 43 is provided around the photoreceptor drum 42. The image forming means 4 has such a known structure that a document image is formed so as to form an electrostatic latent image on the outer periphery of the photoreceptor drum 42 which is uniformly charged by the electrostatic charger 43, the electrostatic latent image is developed into a toner image by the developing device 41, the toner image is then transferred onto the sheet ST by the transferring charger 44, and residual toner is recovered by the cleaner 45. The developing device 41, photoreceptor drum 42, transferring charger 44 and cleaner 45 of the image forming means 4 are mounted on an image forming frame 46 and united respectively. The electrostatic charger 43 is held by the case 33 of the optical system 3. The image forming frame 46 is made of one piece resin material. A toner recovery container 47 is integrally formed with the image forming frame 46. The toner recovery container 47 houses therein toner recovered by the cleaner 45 and has a rectangular plane like a tray.

The developing device 41 has a toner cartridge 41*c*, a toner feeding roller 41*d*, an agitating roller 41*e* and a developing roller 41*f*. The toner cartridge 41*c* is removably attached to a developing housing 41*a* which is made of resin. The toner feeding roller 41*d* feeds toner which is dropped and supplied from the toner cartridge 41*c* to the inside of the developing housing 41*a*. The agitating roller 41*e* agitates the toner fed to the inside of the developing housing 41*a*. The developing roller 41*f* supplies the toner to the photoreceptor drum 42. The developing housing 41*a* of the present embodiment has a lot of rib-shaped upper guides 41*b* on its lower face. The upper guides 41*b* are protruded in parallel with one another so as to guide the sheet ST which is to be delivered into the body 2. A sensor, i.e., microswitch S1 is fixed onto the upper guide 41*b* (see FIG. 2). The microswitch S1 detects that the sheet ST is introduced into the paper feeder 26. The electrical equipment 8 (see FIG. 2) is constructed so as to be rotated and driven through all the steps of copy operation, i.e., while the tip of the sheet ST is inserted into the delivery rollers 51 of the sheet delivery mechanism 5 to be described below, is halted and is then delivered in the case where the microswitch S1 detects the sheet ST.

Body

The body 2 includes upper and lower casings 24 and 25 which are made of resin and separably screwed to each other. The upper and lower casings 24 and 25 have upper and lower passage forming members F1 and F2, respectively. The upper passage forming member F1 serves as a housing of the image forming means 4 and forms the upper side of the sheet delivery passage. The lower passage forming member F2 forms the lower side of the sheet delivery passage opposite to the upper passage forming member F1.

Passage Forming Member

More specifically, the upper passage forming member F1 has the developing housing 41*a* of the developing device 41, the image forming frame 46 of the image forming means 4, and the toner recovery container 47 integrally formed therewith. A supporting stay 63 is fixed onto the lower face of the toner recovery container 47 as the passage forming member F1 (see FIG. 2). The supporting stay 63 supports the heat roller 61 of the image fixing device 6.

Figure 3:
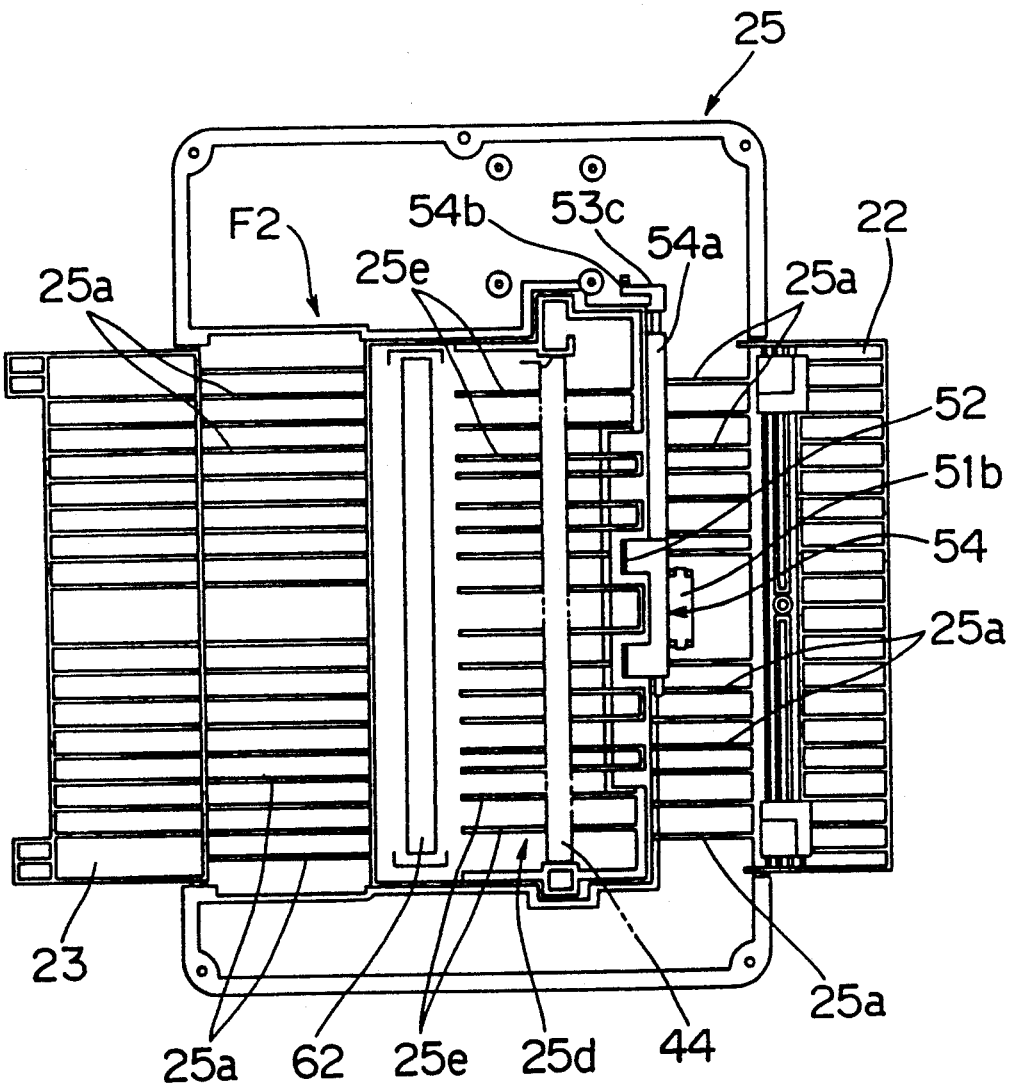
FIG. 3 is a plan view of a lower casing forming the copying machine body.

The lower passage forming member F2 is formed by the bottom of the lower casing 25 and a supporting member 25*d* which is made of resin (see FIG. 3). The lower casing 25 has lower guides 25*a* integrally formed therewith. The supporting member 25*d* is provided on the bottom of the lower casing 25 so as to be rotatable around a supporting point 25*c*, and has lower guides 25*e* integrally formed therewith so as to be aligned with the lower guides 25*a*. A pressure roller 62 of the image fixing device 6 is pivoted through a supporting shaft 62*a* in the vicinity of the supporting point 25*c* of the supporting member 25*d*.

Sheet Delivery Mechanism

The sheet delivery mechanism 5 of the present embodiment includes a pair of delivery rollers 51, sheet halting means, and pinching force adjusting means. The delivery rollers 51 have a drive roller 51*a* and a roller 51*b* driven with the drive roller 51*a* attached to the passage forming members F1 and F2 respectively, and hold the sheet ST between the rollers 51*a* and 51*b* and deliver the same along the sheet delivery passage of the copying machine such that the roller 51*b* (51*a*) can separate from the roller 51*a* (51*b*). The sheet halting means halts the sheet ST delivered by the delivery rollers 51 by coming in contact with the tip of the sheet ST. The pinching force adjusting means adjusts the delivery rollers 51 into a first state (shown in FIGS. 1, 4 and 5) where the sheet pinching force of the delivery rollers 51 is relatively small so that the halted sheet ST can slip on the delivery rollers 51, and adjusts the delivery rollers 51 into a second state (shown in FIGS. 6, 7 and 8) where the sheet pinching force is increased so that the sheet ST can surely be delivered in the case where the sheet ST is released from a halt and then delivered.

Pair of Delivery Rollers

With reference to FIG. 2, the drive roller of the delivery rollers 51, i.e., the upper roller 51*a* is supported by the supporting shaft 51*c*. An input gear 51*d* is provided on one end of the supporting shaft 51*c*. The input gear 51*d* is rotated and driven by the drive system 7. The upper roller 51*a*, supporting shaft 51*c* and input gear 51*d* are integrally formed of resin. Consequently, it is possible to reduce the number of parts and assembly mandays. A rubber tube 51*e* is wound up around the delivery rollers 51. The rubber tube 51*e* is wound up with predetermined tensile force loaded so as not to be rotated relative to the upper roller 51*a*, and is rotatably supported on the supporting shaft 51*c* by the upper guide 41*b* of the developing housing 41*a*.

Figure 4:
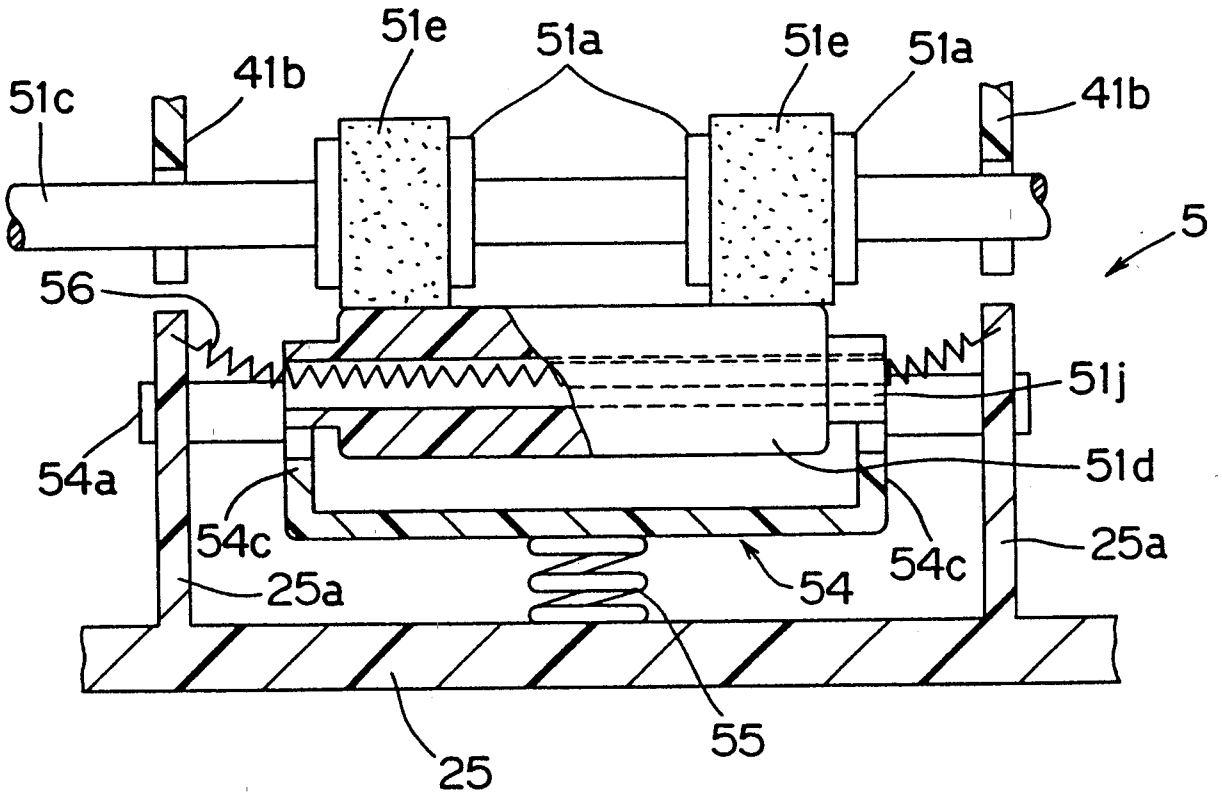
FIG. 4 is a section view of a sheet delivery mechanism in a first state according to the present invention.

With reference to FIGS. 3 and 4, the driven roller of the delivery rollers 51, i.e., the lower roller 51*b* is hollow and made of resin. In addition, the lower roller 51*b* has a small diameter cylinder 51*j* on its both ends integrally and concentrically. The inner portion of the lower roller 51*b* is supported between a pair of lower guides 25*a* through a coil spring 56 as first urging means to be described below.

Sheet Halting Means

Figure 5:
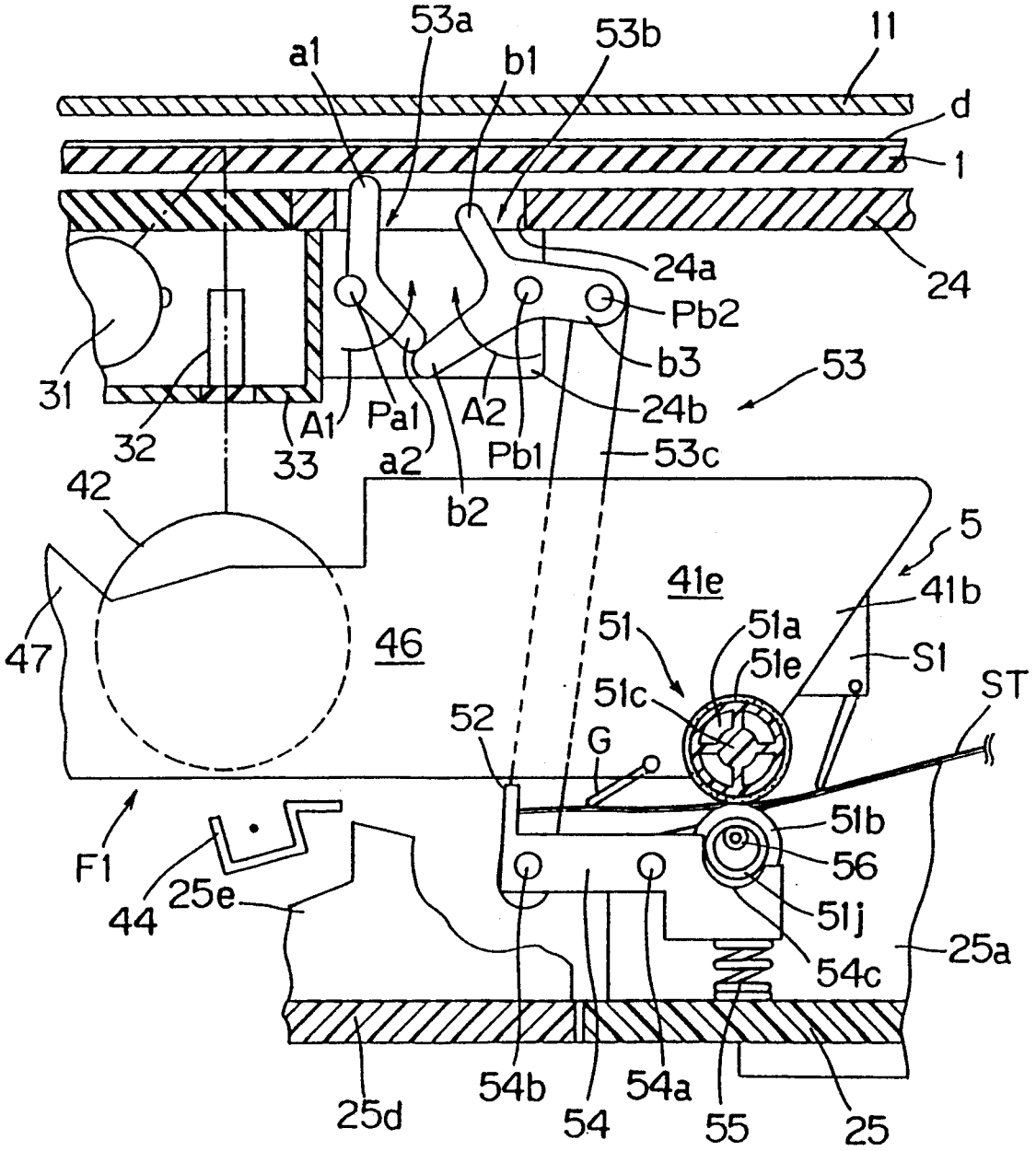
FIG. 5 is a side view of the sheet delivery mechanism in the first state according to the present invention.

With reference to FIG. 5, the sheet halting means of the present embodiment is in the form of a stopper click 52 which is integrally formed with a sheet guide 54. The sheet guide 54 guides the sheet ST delivered by the delivery rollers 51.

Stopper Click

The stopper click 52 comes in contact with the tip of the sheet ST to be halted. More specifically, the stopper click 52 projects into the sheet delivery passage in the first state, i.e., while the document table 1 does not start transfer from the home position to the second step. The stopper click 52 retreats from the sheet delivery passage at a predetermined timing to be described below in the second state, i.e., when the document table 1 starts the second step. Consequently, the halted sheet ST is allowed to be delivered.

Pinching Force Adjusting Means

The pinching force adjusting means is provided with first and second urging means. The first urging means always urges the lower roller 51*b* to the upper roller 51*a* in the first and second states. The second urging means further urges the lower roller 51*b* in the second state.

First Urging Means

The first urging means is in the form of the coil spring 56. The coil spring 56 presses the lower roller 51*b* onto the upper roller 51*a* side by the relatively small urging force with its both ends fixed to the corresponding lower guides 25*a* (see FIG. 4). The coil spring 56 causes the delivery rollers 51 to deliver the sheet ST toward the downstream side. When the sheet ST comes in contact with the stopper click 52 which is integrally formed on the downstream end of the sheet guide 54 in a sheet delivery direction, the sheet ST can slip between the rollers 51*a* and 51*b*.

Second Urging Means

The second urging means is provided with position defining means and drive means. The position defining means defines the position of the delivery rollers 51 into the second state. The drive means drives the position defining means into a non-operative condition in the first state and into an operative condition in the second state. The drive means is in the form of a compression coil spring 55 as spring means and switching means. The compression coil spring 55 urges the position defining means into the operative condition. The switching means switches the position defining means into the non-operative condition against the compression coil spring 55 in the first state, and into the operative condition by the urging force of the compression coil spring 55 in the second state.

Position Defining Means

The position defining means of the present embodiment is formed by the sheet guide 54. In other words, the position defining means also serves as the sheet guide 54 for guiding the sheet ST delivered by the delivery rollers 51.

Sheet Guide

More specifically, the sheet guide 54 is provided so as to swing around a supporting shaft 54*a* which is protruded onto the lower guide 25*a* of the lower casing 25. Roller receiving members 54*c* are provided on the upstream end of the sheet guide 54 in the sheet delivery direction. The roller receiving members 54*c* are separably supported by the small diameter cylinder 51*j* of the lower roller 51*b* in order to cause the lower roller 51*b* to come in contact with or separate from the upper roller 51*a*. In the first state shown in FIGS. 4 and 5, while the upstream end is rotated clockwise around the supporting shaft 54*a* in FIG. 5 so as to advance the stopper click 52 to the sheet delivery passage, the roller receiving members 54*c* separate from the small diameter cylinder 51*j* and the sheet guide 54 as the position defining means is held in the non-operative condition against the urging force of the compression coil spring 55. In this state, accordingly, only the coil spring 56 forming the first urging means urges the lower roller 51*b* to the upper roller 51*a*.

Figure 6:
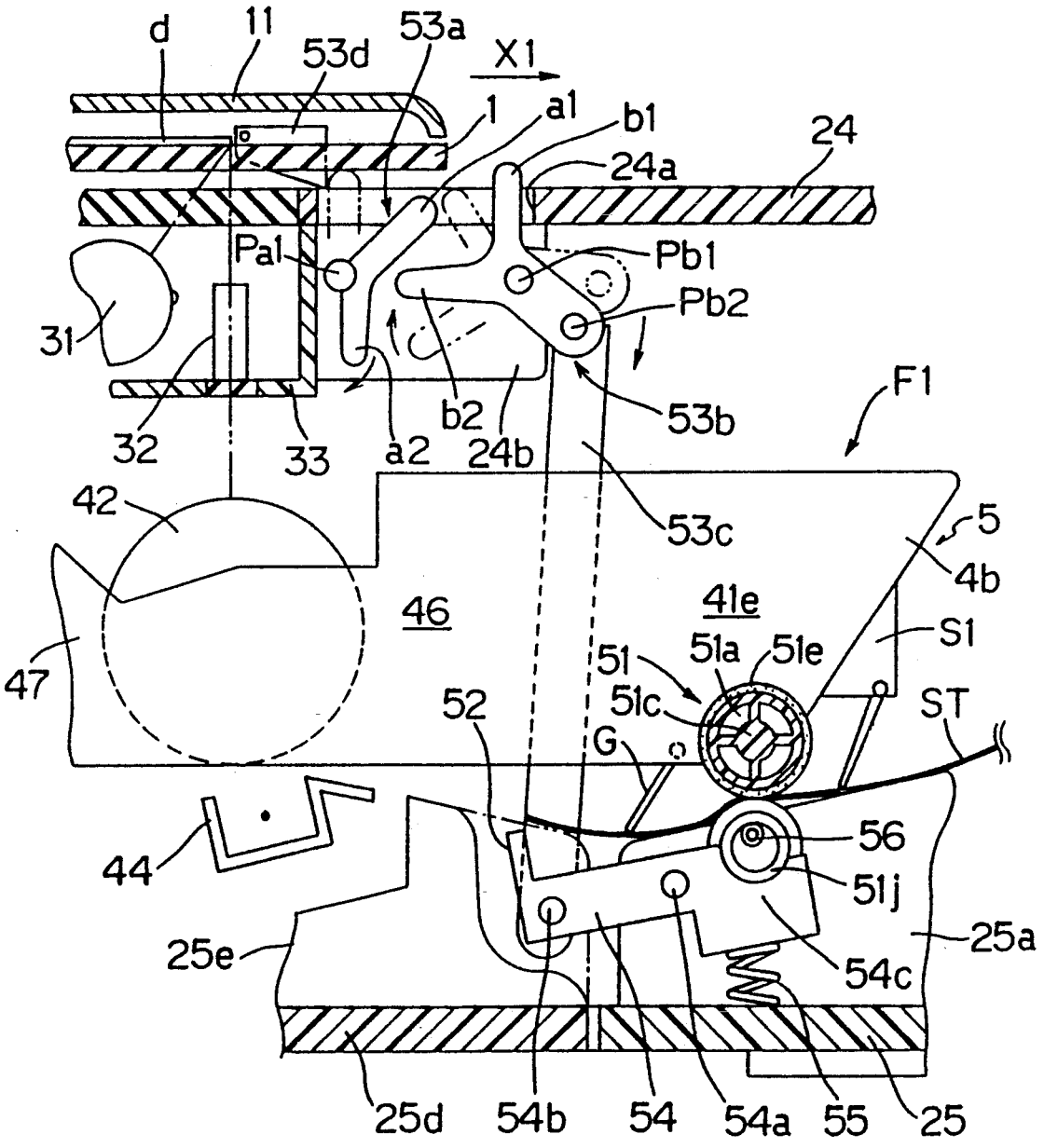
FIG. 6 is a side view showing the process of transferring the sheet delivery mechanism from the first state to a second state according to the present invention.
Figure 7:
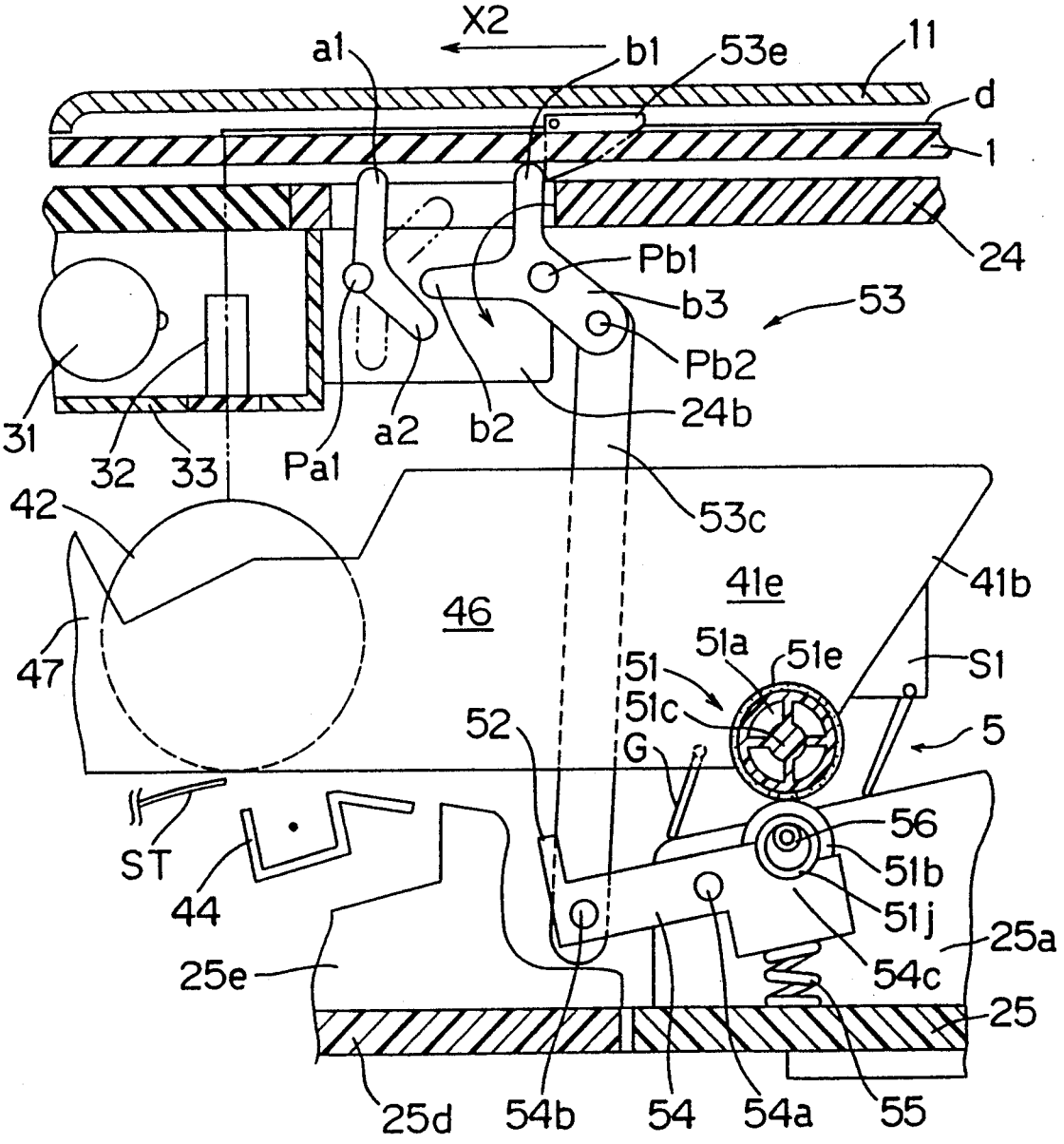
FIG. 7 is a side view of the sheet delivery mechanism in the second state according to the present invention.
Figure 8:
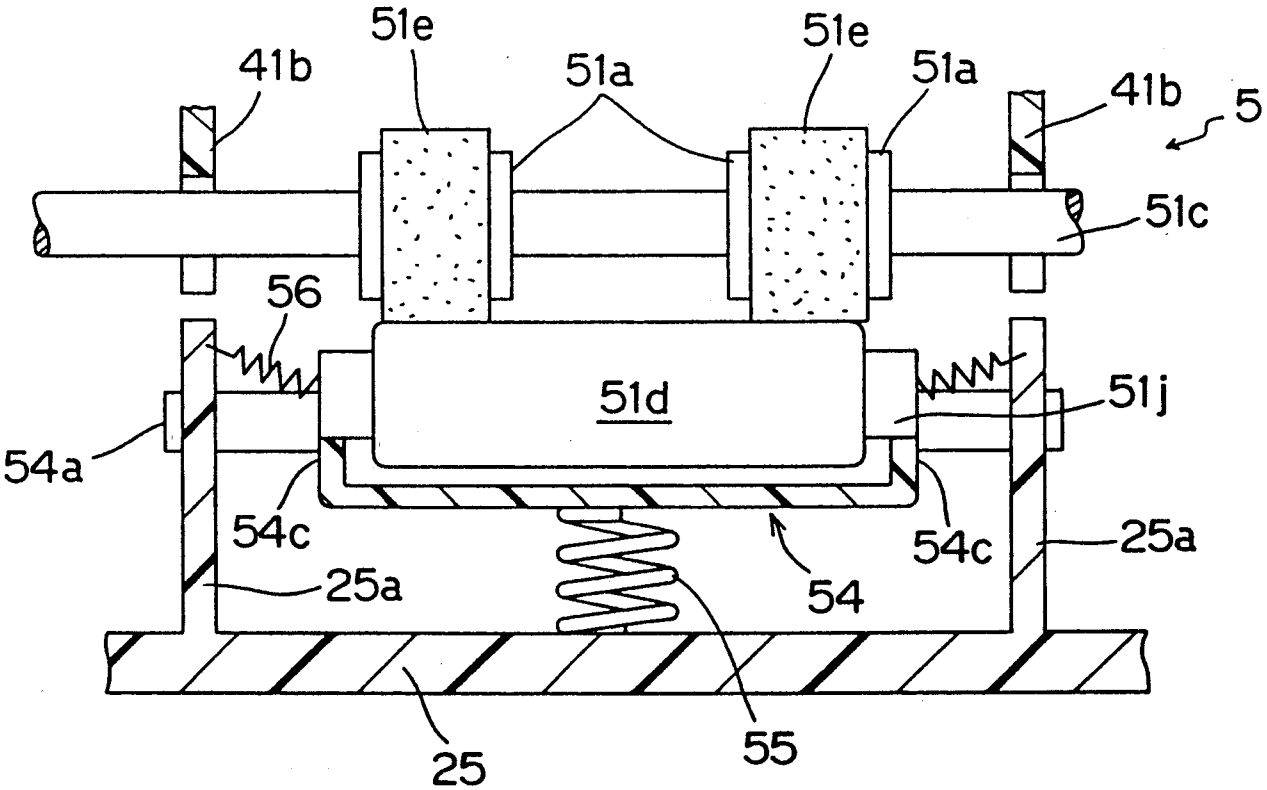
FIG. 8 is a section view of the sheet delivery mechanism in the second state according to the present invention.

In the second state shown in FIGS. 6, 7 and 8, while the upstream end is rotated counterclockwise around the supporting shaft 54*a* in FIG. 6 so as to cause the stopper click 52 to retreat from the sheet delivery passage, the roller receiving members 54*c* come in contact with the small diameter cylinder 51*j* and the sheet guide 54 as the position defining means is held in the operative condition by the urging force of the compression coil spring 55. In this state, accordingly, the lower roller 51*b* is urged to the upper roller 51*a* with the urging force of the compression coil spring 55 added to that of the coil spring 56.

Switching Means (Interlocking Means)

The switching means forms a part of the drive means to switch the sheet guide 54 into the operative and non-operative conditions, and is in the form of a cam mechanism 53 shown in FIGS. 1, 5 and the following. The cam mechanism 53 also serves as interlocking means for causing the sheet guide 54 to interlock with the document table 1, and is provided with a pair of cams 53*d* and 53*e* (see FIG. 1), an operation lever 53*a*, a rotation lever 53*b* and a connecting rod 53*c*. The cams 53*d* and 53*e* are fixed to the document table 1 so as to correspond to a document image exposure distance, and drive the interlocking means at a predetermined timing. The operation lever 53*a* is rotated by the cams 53*d* and 53*e* when the document table 1 moves to a predetermined position. The rotation lever 53*b* is operated by the operation lever 53*a*. The connecting rod 53*c* connects the rotation lever 53*b* to the sheet guide 54.

The levers 53*a* and 53*b* have drive ends a1 and b1 and engagement ends a2 and b2 respectively, and are almost dogleg-shaped. The drive ends a1 and b1 can project from an aperture 24*a* of the upper casing 24, respectively. The engagement ends a2 and b2 can be engaged with each other inside the upper casing 24. The drive ends a1 and b1 correspond to the cams 53*d* and 53*e* respectively, and are pivoted on a supporting fragment 24*b* through pins Pa1 and Pb1 so as to be opposed to each other in a state where the drive ends a1 and b1 can project onto the upper casing 24 and the engagement ends a2 and b2 can be engaged with each other. The supporting fragment 24*b* is suspended from the ceiling face of the upper casing 24. A connecting arm b3 is extended in the vicinity of the pin Pb1 of the rotation lever 53*b*. The upper end of the connecting rod 53*c* is pivoted on the end of the connecting arm b3 by means of the pin Pb2. The sheet guide 54 has a connecting shaft 54*b* formed thereon. The connecting shaft 54*b* is orthogonal to the sheet delivery direction and has its tip end extended to the outside of the sheet delivery passage. The lower end of the connecting rod 53c is rotatably connected to the tip end of the connecting shaft 54b so that the connecting rod 53c does not hinder the delivery of the sheet ST.

In the home position shown in FIG. 5, the operation lever 53a is always urged by a coil spring (not shown) so as to be rotated counterclockwise shown in FIG. 5 around the pin Pa1 as shown by an arrow Al in FIG. 5. The drive end al is held in an attitude where it projects onto the upper casing 24 through the aperture 24a. The rotation lever 53b is rotatably urged clockwise around the pin Pb1 by the urging force of the compression coil spring 55 through the sheet guide 54 and the connecting rod 53c. In the home position shown in FIG. 5, the engagement end b2 of the rotation lever 53b is engaged with the engagement end a2 of the operation lever 53a. Consequently, the rotation lever 53b is held in an attitude where it retreats into the upper casing 24 such that the drive end b1 does not come in contact with the cams 53d and 53e. As a result, the clockwise rotation of the rotation lever 53b is controlled by the operation lever 53a so that the sheet guide 54 connected to the rotation lever 53b through the connecting rod 53c jumps upward against the urging force of the compression coil spring 55, i.e., is held in a sheet halting attitude. Accordingly, the stopper click 52 also projects into the sheet delivery passage. Because the compression coil spring 55 is compressed in the sheet halting attitude, the urging force of the compression coil spring 55 does not act on the lower roller 51b of the delivery rollers 51. For this reason, the lower roller 51b comes in rolling contact with the upper roller 51a only by the small urging force of the coil spring 56.

Action of First Embodiment

There will be described the operation of the present embodiment.

In the home position shown in FIG. 5, when the sheet ST is fed from the paper feeder 26 (see FIG. 1), the microswitch S1 detects paper feeding and the drive system 7 (see FIG. 2) is operated to rotate and drive the delivery rollers 51. Consequently, the sheet ST is introduced into the body 2. At this time, the sheet guide 54 is held in the sheet halting attitude by the cam mechanism 53, so that the tip of the sheet ST comes in contact with the stopper click 52 so as to be halted and stand by on this side of the photoreceptor drum 42.

In the sheet halting attitude, the sheet guide 54 as the position defining means is held in a non-operative condition. As a result, the compression coil spring 55 is compressed so that its urging force does not act on the lower roller 51b. Accordingly, the pinching force of the delivery rollers 51 is generated only by the urging force of the coil spring 56. Consequently, when the sheet ST comes in contact with the stopper click 52, the sheet ST can slip between the rollers 51a and 51b. Thus, there is not a possibility that the sheet ST crushes between the stopper click 52 and the delivery rollers 51, the sheet ST comes in contact with the stopper click 52 and is greatly curved, and the sheet ST separates from the stopper click 52.

With reference to FIG. 6, when the document table 1 is transferred from a first step to a second step, the document d is started to be illuminated and scanned, and the operation lever 53a is rotated clockwise by the first cam 53d. As a result, the engagement end a2 of the operation lever 53a is disengaged with the engagement end b2 of the rotation lever 53b. Consequently, the rotation lever 53b is made free so that the compression coil spring 55 is extended to rotate the sheet guide 54 counterclockwise around the supporting shaft 54a. Consequently, the sheet guide 54 is switched into a delivery allowance attitude so that the stopper click 52 retreats to the outside of the sheet delivery passage. At the same time, when the compression coil spring 55 is extended, the sheet guide 54 as the position defining means is held in the operative condition. As a result, the upstream end of the sheet guide 54 presses the lower roller 51b against the upper roller 51a, and the lower roller 51b presses the sheet ST against the upper roller 51a with the urging force of the compression coil spring 55 added to that of the coil spring 56. Accordingly, the sheet ST is surely supplied to the photoreceptor drum 42 side with being rigidly welded to the rollers 51a and 51b by pressure.

According to the present embodiment, the sheet ST can surely be supplied to the photoreceptor drum 42 side by pressing the lower roller 51b against the upper roller 51a with the urging force of the compression coil spring 55 added to that of the coil spring 56 at the time of sheet delivery. Consequently, it is not required that auxiliary delivery rollers are provided on the downstream side of the stopper click 52. In addition, the stopper click 52 is caused to mechanically retreat interlockingly with the document table 1. Thus, the supply timing of the sheet ST can be prevented from varying.

With reference to FIGS. 7 and 8, the rotation lever 53b is rotated around the pin Pb1 such that the drive member b1 projects onto the upper casing 24 through the aperture 24a according to the rotating operation of the sheet guide 54, i.e., the switching operation of the operative condition when the rotation lever 53b is made free in the second step. In this state, when the document table 1 is transferred from the second step to the third step, the drive end b1 of the rotation lever 53b is driven counterclockwise by the second cam 53e. As a result, the engagement end b2 of the rotation lever 53b returns to an attitude shown in FIG. 5 while pressing down the engagement end a2 of the operation lever 53a, and is engaged therewith. Consequently, the sheet guide 54 also returns to the sheet halting attitude against the urging force of the compression coil spring 55, and the stopper click 52 advances to the sheet delivery passage again. The lower roller 51b returns to the attitude shown in FIGS. 1, 4 and 5 together with the cam mechanism 53 according to the operation of switching the attitudes of the sheet guide 54, i.e., the operation of rotating the sheet guide 54 clockwise around the supporting shaft 54a, so that the pressure welding force between the upper and lower rollers 51a and 51b is reduced. Thereby, the levers 53a and 53b also return to the attitudes shown in FIGS. 1, 4 and 5, and the document table 1 returns to the home position. Thus, copy operation is completed.

Second Embodiment

There will be described another embodiment shown in FIG. 9 and the following. According to the present embodiment, there is adopted a body 102 having sheet delivery upstream and downstream sides curved, and having a sheet delivery mechanism 105 provided therein.

Body

An upper casing 124 forming the body 102 is specified by an upper passage forming member F11. The upper passage forming member F11 has a developing housing 141*e*, an image forming frame 146 and a toner recovery container 147 formed integrally. The upper passage forming member F11 is the same as in FIG. 1 except that their external shapes are different from each other. Therefore, the same members have the same reference designations and residual description will be omitted.

The bottom of a lower casing 125 of the body 102 has a lower passage forming member F12 to which a sheet delivery passage is attached so a to be opened. The lower face side of the sheet delivery passage is formed by the lower passage forming member F12. The lower passage forming member F12 has a transferring charger 44 and a pressure roller 62 of an image fixing device 6 attached thereto in similar to the embodiment shown in FIG. 1. A manual guide 126*a* for specifying a paper feeder 126 is provided on the upstream side of the delivery passage of the lower passage forming member F12.

Sheet Delivery Mechanism

The sheet delivery mechanism 105 comprises a pair of delivery rollers 51, a sheet guide 154, supporting means switching means and sheet halting means. The delivery rollers 51 hold therebetween a sheet ST introduced through the manual guide 126*a* of the paper feeder 126 and feed the same to the sheet delivery passage of the copying machine body 102. The sheet guide 154 guides the sheet ST delivered by the delivery rollers 51. The supporting means supports the sheet guide 154 such that the sheet guide 154 can be switched into a sheet halting attitude (shown in FIGS. 9 and 10) for preventing the sheet from being delivered and a delivery allowance attitude (shown in FIGS. 12 and 13) for allowing the sheet to be delivered. The switching means switches the attitudes of the sheet guide 154. The sheet halting means is integrally formed with the lower passage forming member F12 forming a sheet delivery passage and comes in contact with the tip of the sheet ST guided by the sheet guide 154 having the sheet halting attitude to halt the sheet ST.

Pair of Delivery Rollers

The delivery rollers 51 include upper and lower rollers 51*a* and 51*b* in similar to the delivery rollers 51 shown in FIG. 1 and the following. The upper and lower rollers 51*a* and 51*b* are attached to the upper and lower passage forming members F11 and F12, respectively. In similar to FIG. 1, the lower roller 51*b* is gently urged to the upper roller 51*a* side by the urging force of a coil spring 56 as first urging means of which both ends are fixed to lower guides 154*b* (see FIGS. 10 and 13).

Sheet Guide

In similar to the sheet guide 54 shown in FIG. 1, the sheet guide 154 also serves as position defining means for defining the position of the delivery rollers 51 into a second state. The downstream end of the sheet guide 154 is always urged to the sheet delivery passage side by a compression coil spring 55 as spring means. The compression coil spring 55 is provided between the sheet guide 154 and the bottom of a dent 150. An engagement dent 154*c* is provided between both ends of the sheet guide 154. The engagement dent 154*c* is engaged with the lower roller 51*b* from below. Accordingly, the sheet guide 154 has such an attitude that the sheet ST can be engaged with the sheet halting means to be described below (see FIGS. 9 and 10) and is held in a non-operative condition in a first state, i.e., while the document table 1 is transferred from a home position to a second step. In a second state, i.e, when the document table 1 is transferred to the second step, the sheet guide 154 lifts up the tip of the sheet ST halted at a predetermined timing to be described below and is held in an operative condition in which pinching force can be applied to the delivery rollers 51 so as to guide the sheet ST to the photo receptor drum 42 side. The sheet guide 154 is almost U-shaped in section such that its upper face can deliver the sheet to the photoreceptor drum 42.

Supporting Means

Figure 9:
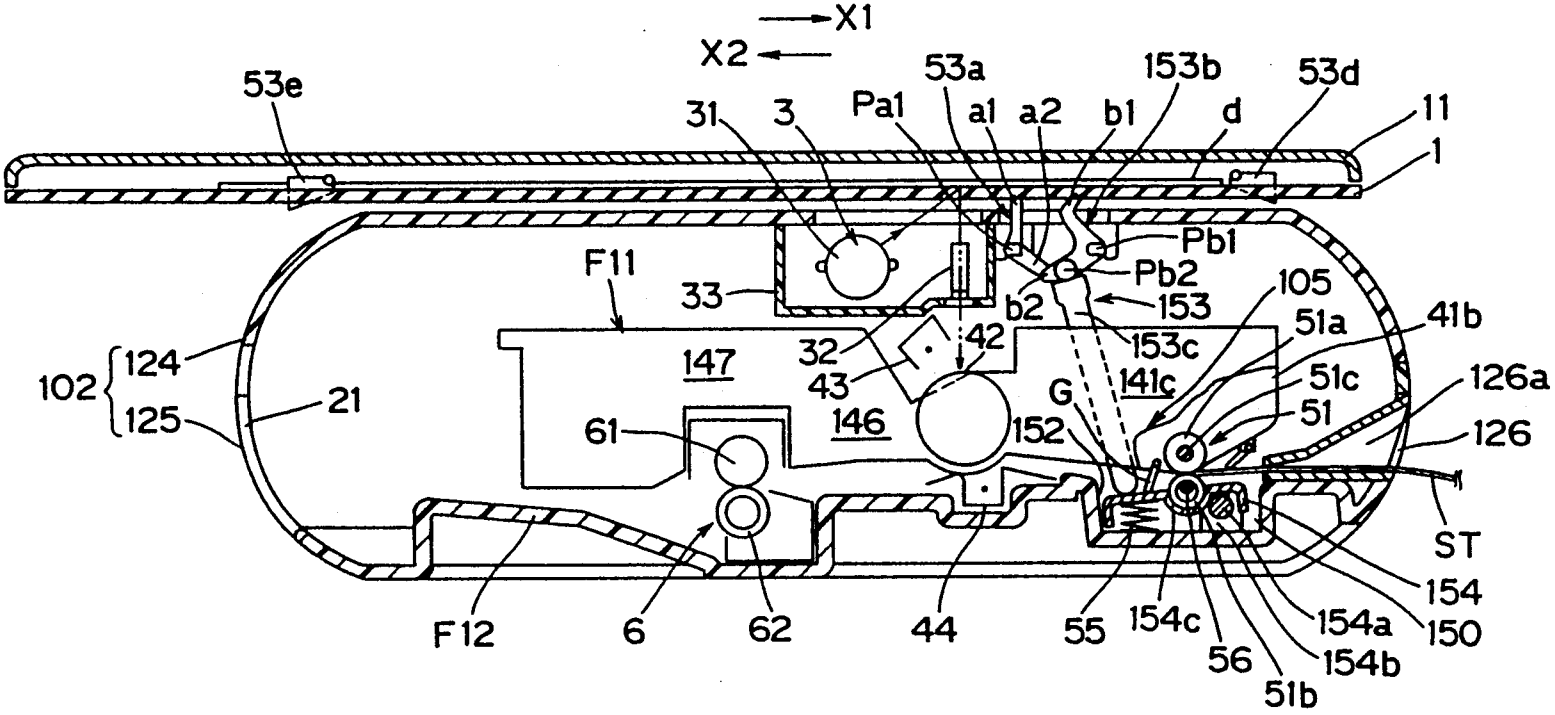
FIG. 9 is a section view of a copying machine as a sheet treatment apparatus according to another embodiment of the present invention.
Figure 10:
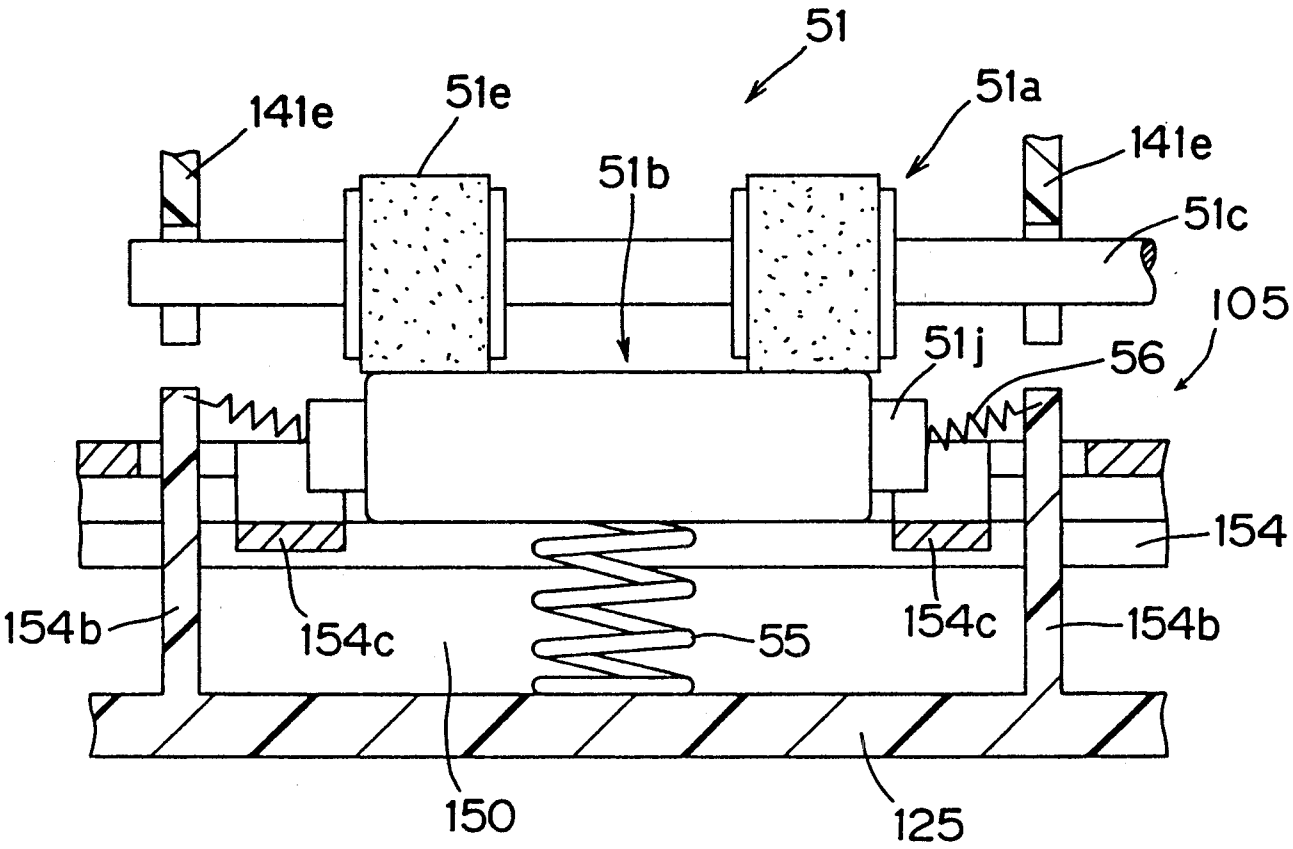
FIG. 10 is a section view of a sheet delivery mechanism shown in FIG. 9 in a first state.
Figure 11:
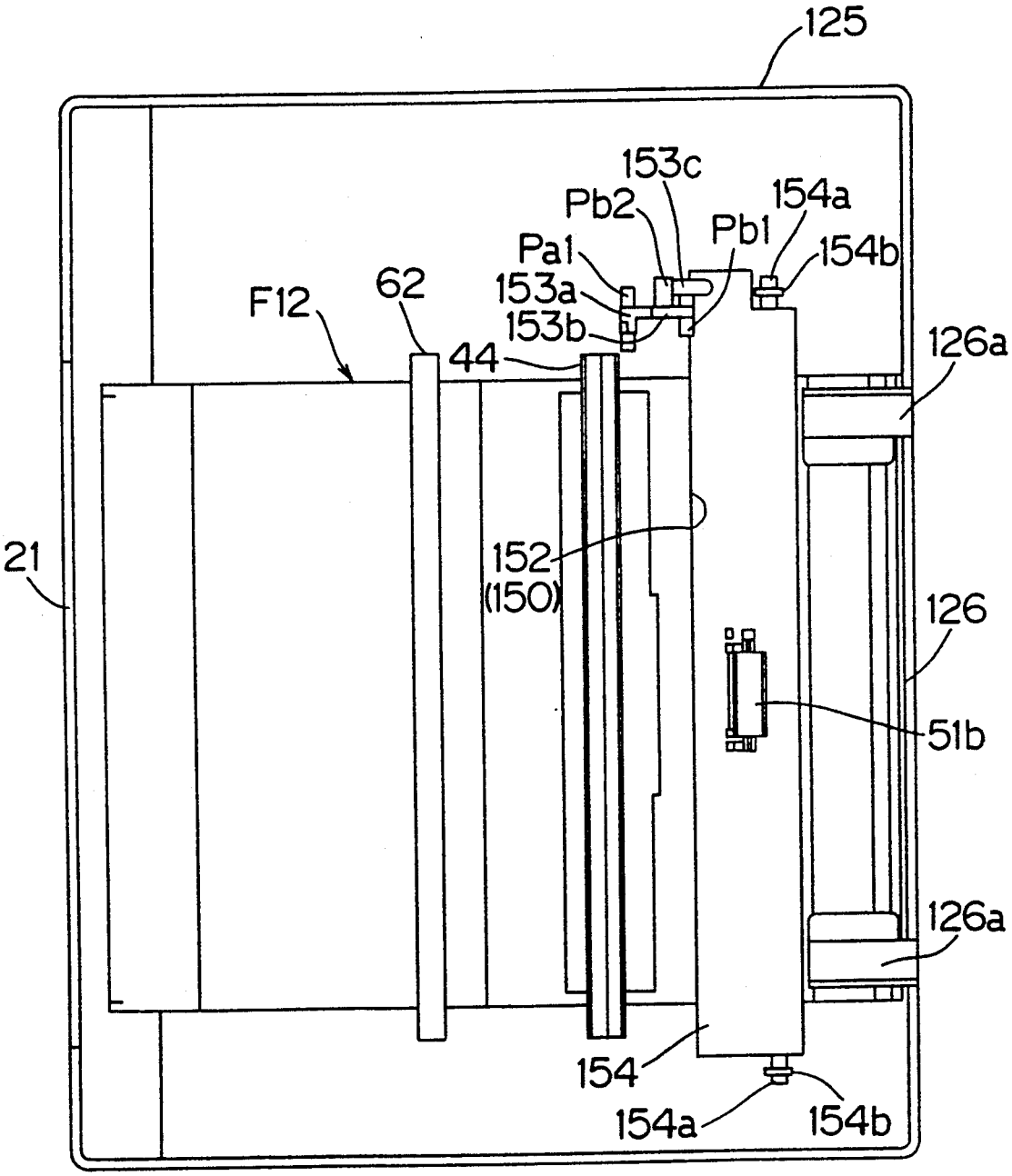
FIG. 11 is a plan view of a lower casing forming a copying machine body shown in FIG. 9.

With reference to FIGS. 9 and 10, the upstream end of the sheet guide 154 in a sheet delivery direction is pivoted on a supporting fragment 154*b* through a supporting shaft 154*a* forming supporting means such that the sheet guide 154 can be switched into each attitude (see FIG. 11). The supporting fragment 154*b* is protruded from the bottom of the dent 150.

Switching Means

The switching means is in the form of a cam mechanism 153. The cam mechanism 153 is the same as the cam mechanism 53 shown in FIGS. 5 to 7 except that there is adopted a connecting rod 153*c* of which lower end is mounted on an end of the sheet guide 154 in a width direction, the connecting arm b3 of the rotation lever 53 shown in FIGS. 5 to 7 is omitted and there is adopted a rotation lever 153*b* which connects the upper end of the connecting rod 153*c* to an engagement end b2 by means of a pin Pb2, and the sheet guide 154 is held in a non-operative condition by pressing down the sheet guide 154 in the first state and held in an operative condition by releasing press-down in the second state.

Sheet Halting Means

With reference to FIG. 11, the sheet halting means of the present embodiment is formed by an inner sideward surface 152 of the dent 150 on the delivery passage downstream side. The dent 150 is provided between the manual guide 126*a* and the transferring charger 44 of the lower passage forming member F12. The inner sideward surface, i.e., a stopper 152 causes the tip of the sheet ST delivered through the delivery rollers 51 along the delivery passage to come in contact therewith, so that the sheet ST is halted on this side of the photoreceptor drum 42 to hold the positional relationship between the sheet ST and the photoreceptor drum 42 and to control the start position of the sheet ST in similar to the stopper click 52 according to the embodiment shown in FIG. 1.

Action of Second Embodiment

According to a structure shown in FIG. 9 and the following, the tip of the sheet ST is engaged with the stopper 152 and is thereby halted and stands by on this side of the photoreceptor drum 42 while the sheet guide 154 has a sheet halting attitude, i.e., it is held in the non-operative condition. Pinching force is applied to the delivery rollers 51 by the urging force of the coil spring 56 as first urging means.

When the sheet guide 154 is switched into the delivery allowance attitude by the action of the cam mechanism 153, the sheet ST engaged with the inner sideward surface 152 of the stopper, i.e., dent 150 is lifted onto the sheet delivery passage by the sheet guide 154. When the sheet guide 154 is switched into the delivery allowance attitude, it is held in the operative condition as the position defining means. Consequently, the pinching force between the upper and lower rollers 51*a* and 51*b* is increased so that the sheet ST pinched therebetween advances toward the photoreceptor drum 42. Thus, copy operation is carried out.

According to the present embodiment, the stopper 152 is integrally formed with the lower passage forming member F12 which specifies the delivery passage, and causes the tip of the sheet ST to be engaged therewith and the sheet ST to temporarily stand by on this side of the photoreceptor drum 42, so that the start position of the sheet ST is controlled. Consequently, the start position of the sheet ST is determined only by the positional precision of the lower passage forming member F12 for the photoreceptor drum 42.

Figure 12:
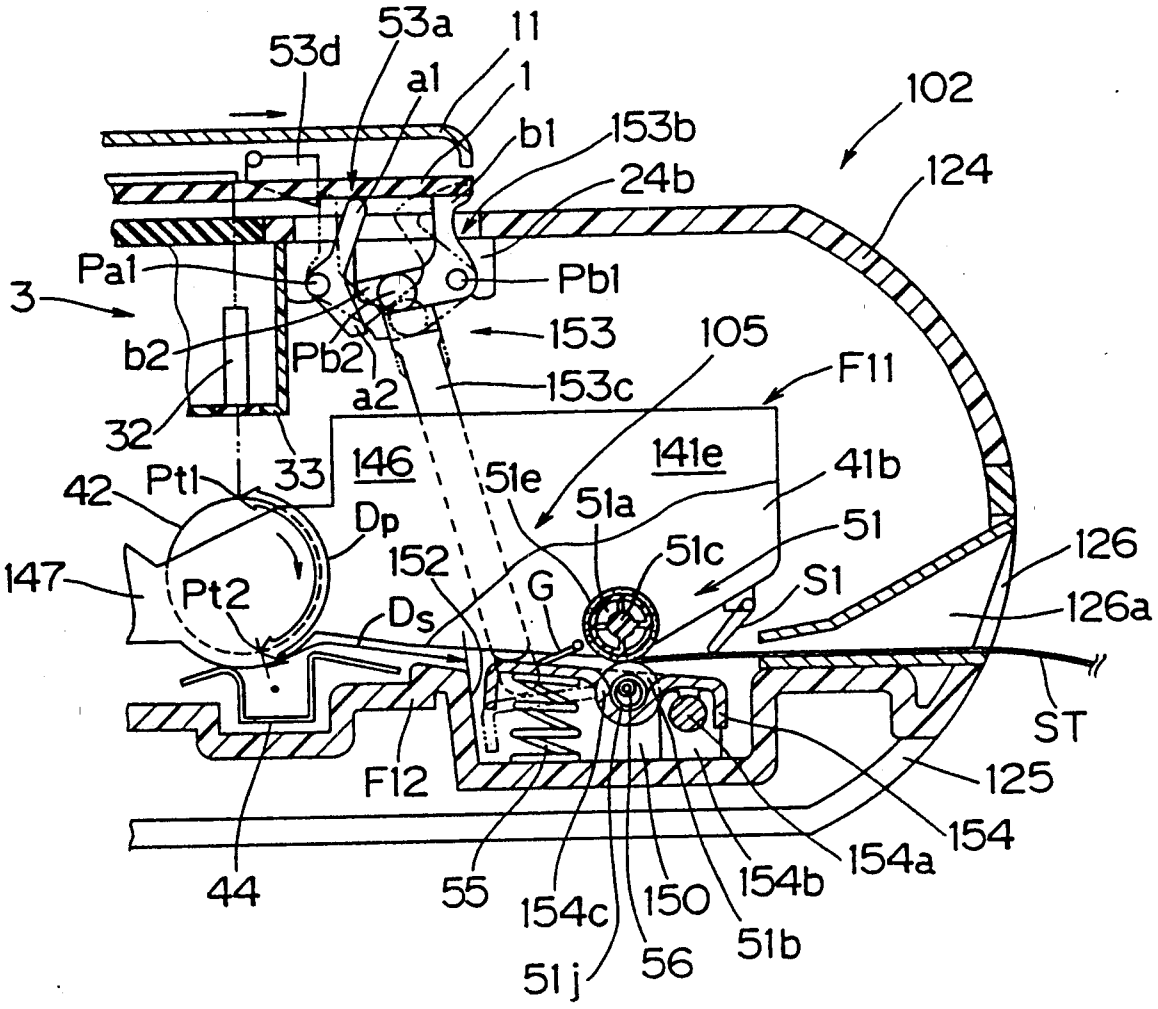
FIG. 12 is an enlarged section view of a main part of the copying machine shown in FIG. 9.
Figure 13:
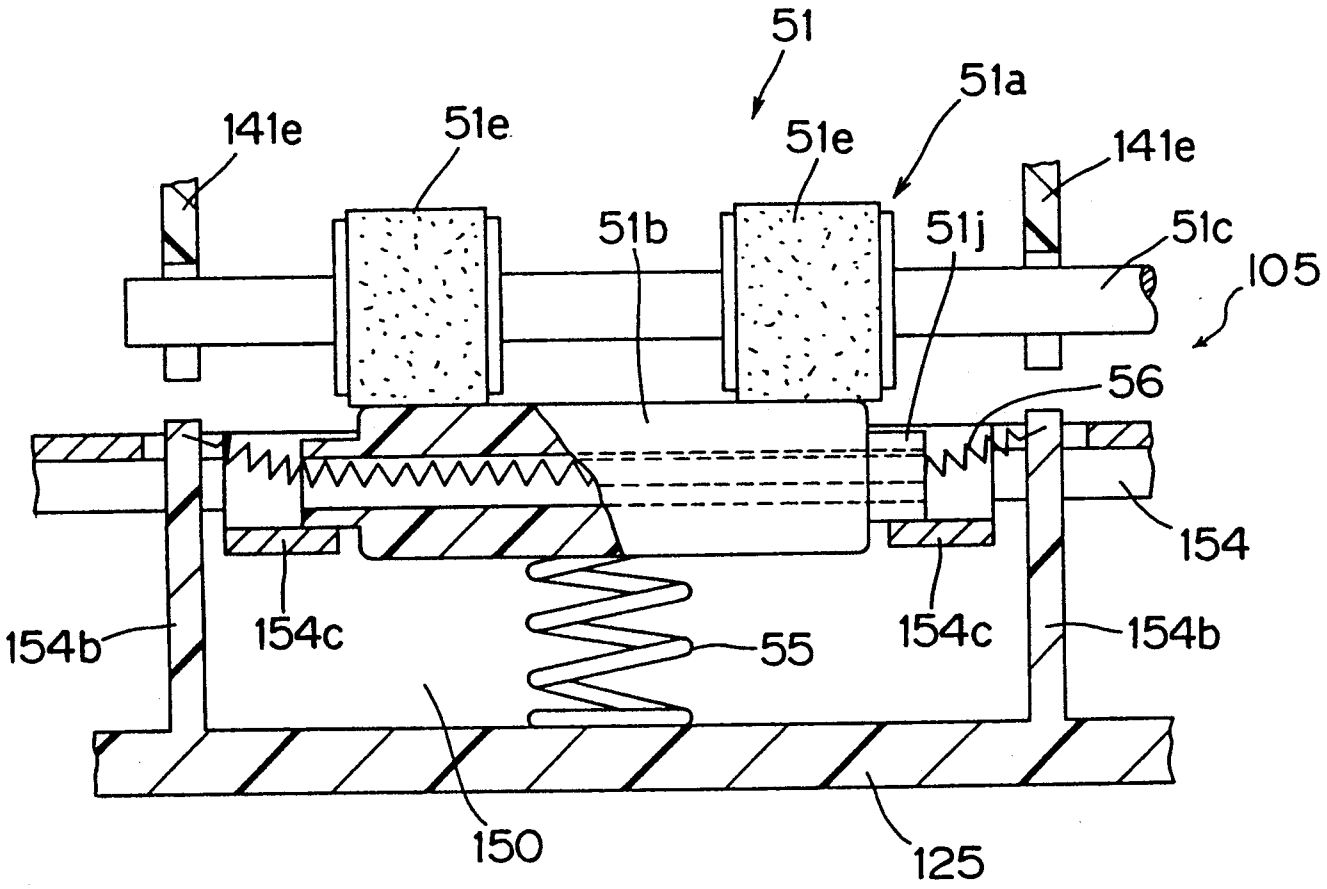
FIG. 13 is a section view of the sheet delivery mechanism shown in FIG. 9 in a second state.

Description will be given in more detail with reference to FIG. 12. On the outer periphery of the photoreceptor drum 42, Pt1 denotes a position in which a document image is exposed by an optical system 3, Pt2 denotes a position in which the document image developed into a toner image by the transferring charger 44 is transferred onto the sheet ST, Dp denotes an image holding length, i.e., a length from the exposure position Pt1 to the transferring position Pt2 on the outer periphery of the photoreceptor drum 42, Ds denotes a sheet delivery distance from the stopper 152 to the transferring position Pt2, Vd denotes a rotary speed of the photoreceptor drum 42 for the image holding length Dp, and Vp denotes a speed of the sheet ST which passes through the sheet delivery distance Ds. In this case, it is required that the following formula is satisfied so as to cause the delivery of the sheet ST to synchronize with transferring operation.

$$Dp/Vd = Ds/Vp$$

According to the present embodiment, the start position of the sheet ST, i.e., the distance Ds from the stopper 152 to the transferring position Pt2 of the sheet ST is determined only by the positional precision of the lower passage forming member F12. Differently from a structure in which the start position of the sheet ST is controlled by the sheet guide, consequently, the positional relationship between the photoreceptor drum 42 and the start position of the sheet ST can be prevented from varying. Accordingly, also in the case where a state in which the sheet ST is engaged with the stopper 152 by the sheet guide 154 is released at a predetermined timing so as to feed the sheet ST to the photoreceptor drum 42, the position of the tip of the sheet ST does not vary. Thus, it is possible to prevent the position of the tip of an image on the sheet ST from being shifted.

Third Embodiment

Figure 14:
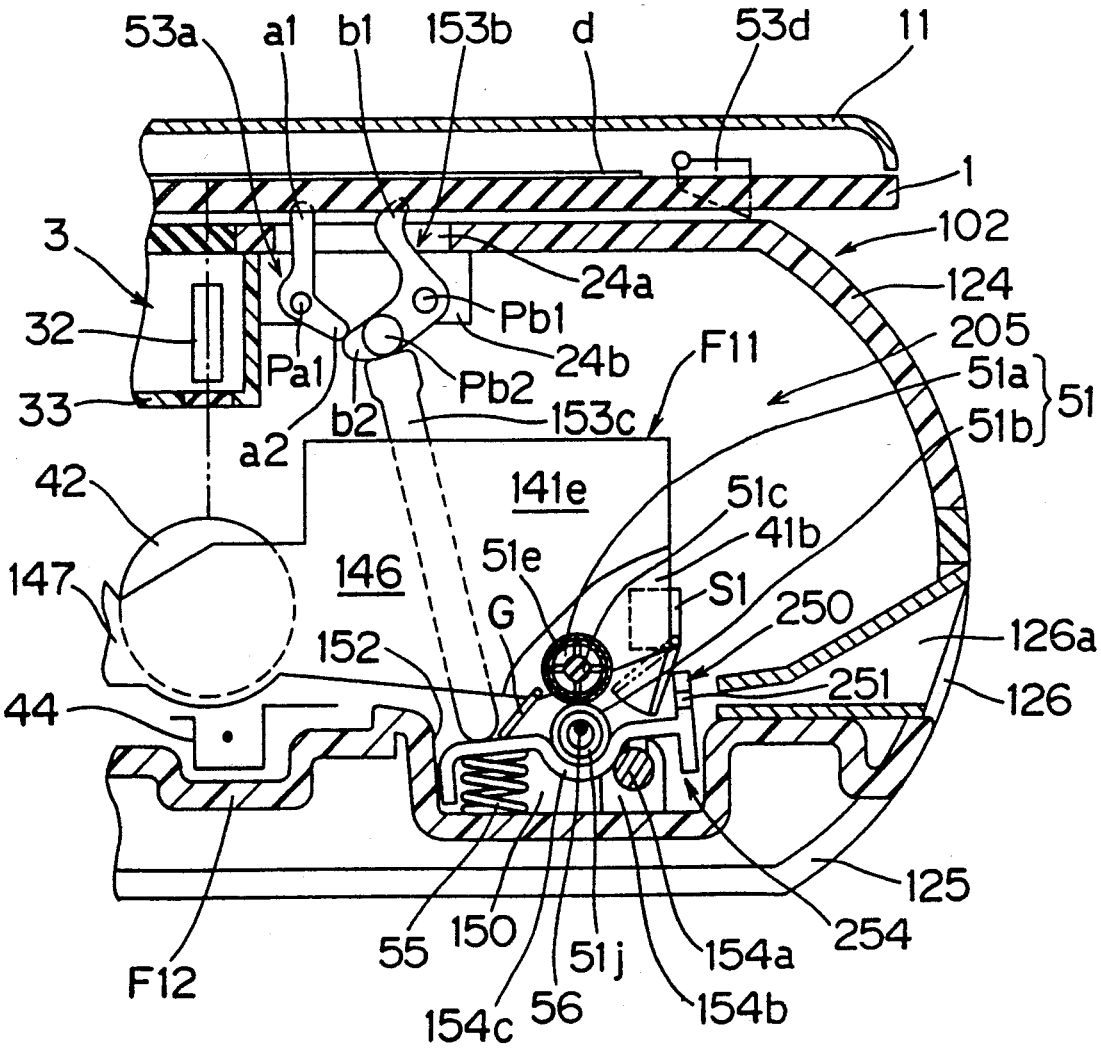
FIG. 14 is an enlarged section view of a main part of a copying machine as a sheet treatment apparatus according to yet another embodiment of the present invention.

In FIG. 14 and the following, there is shown a sheet delivery mechanism 205 which adopts drive preventing means.

Drive Preventing Means

The drive preventing means is provided on a sheet guide 254 which is the same as in the second embodiment, and prevents delivery rollers 51 from being driven when a copying machine is reactivated in a state where a document table 1 does not return to an idling condition, i.e., a home position. According to the present embodiment, the drive preventing means is in the form of a preventing member 250 which is integrally formed with the sheet guide 254 on the sheet delivery upstream side.

Preventing Member

The preventing member 250 is plate-shaped and formed on the upstream side of a microswitch S1. The microswitch S1 is provided on the upstream side of the delivery rollers 51. As shown in FIGS. 14 and 16, there is formed a through hole 251 for causing a sheet ST to pass from a paper feeder 126 to the delivery rollers 51 when the sheet guide 254 has a sheet halting attitude. When the copying machine is reactivated in a state where the document table 1 does not return to the idling condition, the preventing member 250 prevents the delivery rollers 51 from being driven (see FIG. 15).

Action of Third Embodiment

Figure 15:
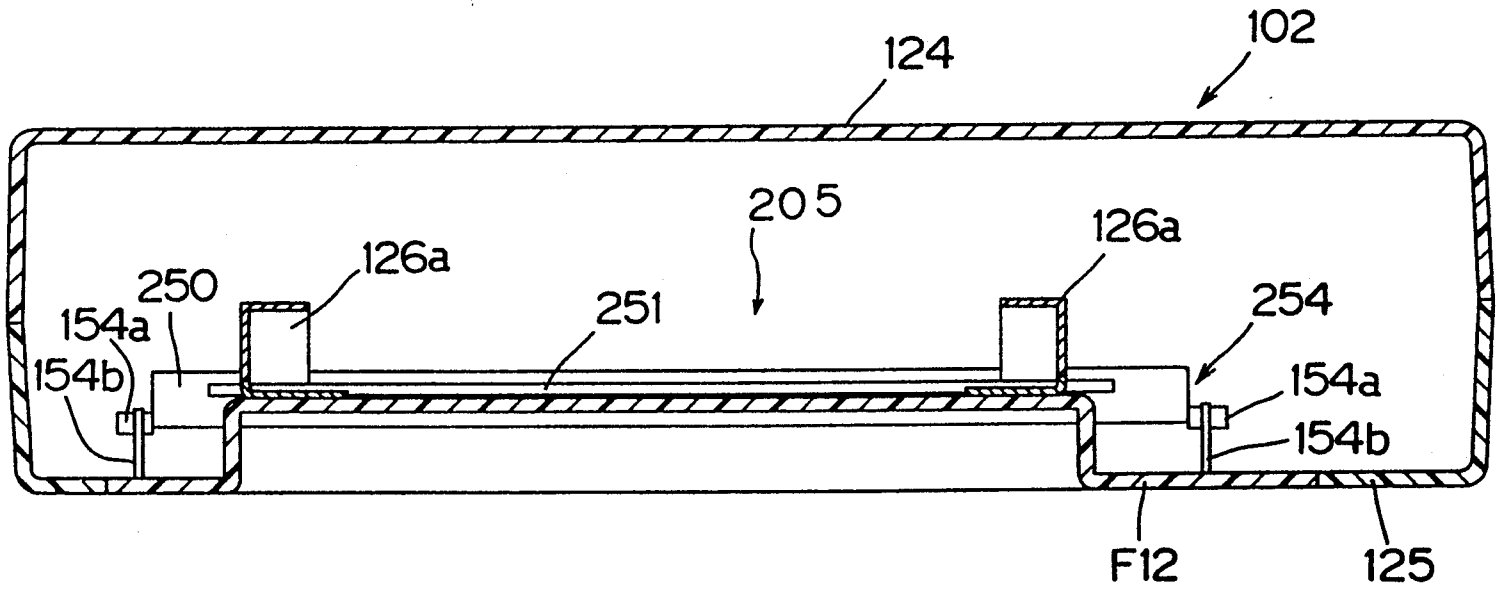
FIG. 15 is a lateral section view of the copying machine shown in FIG. 14 in a first state.
Figure 16:
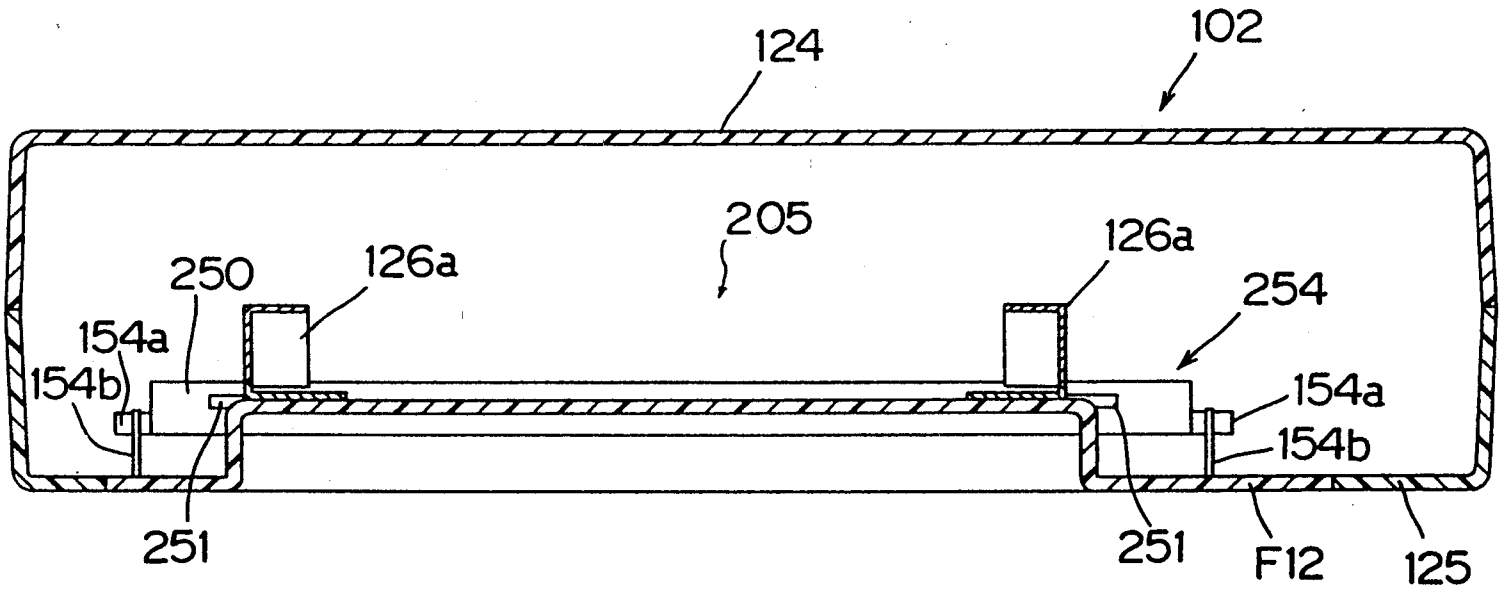
FIG. 16 is a lateral section view of the copying machine shown in FIG. 14 in a second state.

According to the above-mentioned structure, while the sheet guide 254 has the sheet halting attitude, the through hole 251 opens a sheet delivery passage as shown in FIGS. 14 and 15. Consequently, normal copy operation can be carried out.

When the sheet guide 254 has a delivery allowance attitude during copy operation, a delivery passage from the paper feeder 126 to the delivery rollers 51 is blocked by the preventing member 250 as shown in FIG. 16. As a result, in the case where the document table 1 stops due to clogging or the like, the sheet ST is prevented from being inserted on the upstream side of the microswitch S1 by the preventing member 250 even if the copying machine is reactivated in a state where the sheet guide 254 has the delivery allowance attitude, i.e., the document table 1 does not return to the home position, and the delivery rollers 51 are also kept stopping.

According to the present embodiment, if the document table 1 returns to the home position, and a cam mechanism 153 and the sheet guide 254 are reset to the idling condition, the copying machine can be reactivated. Consequently, it is possible to prevent copy errors (mistreatment of the sheet ST) from being caused by the poor synchronization of the copy operation.

In the above-mentioned embodiment, if the top of the preventing member 250 of the sheet guide 254 is provided on the lower side of a manual guide 226*a* to allow the sheet ST to pass when the sheet guide 254 has the sheet halting attitude, it is not required that the through hole 251 for causing the sheet ST to pass is formed on the preventing member 250.

Fourth Embodiment

Figure 17:
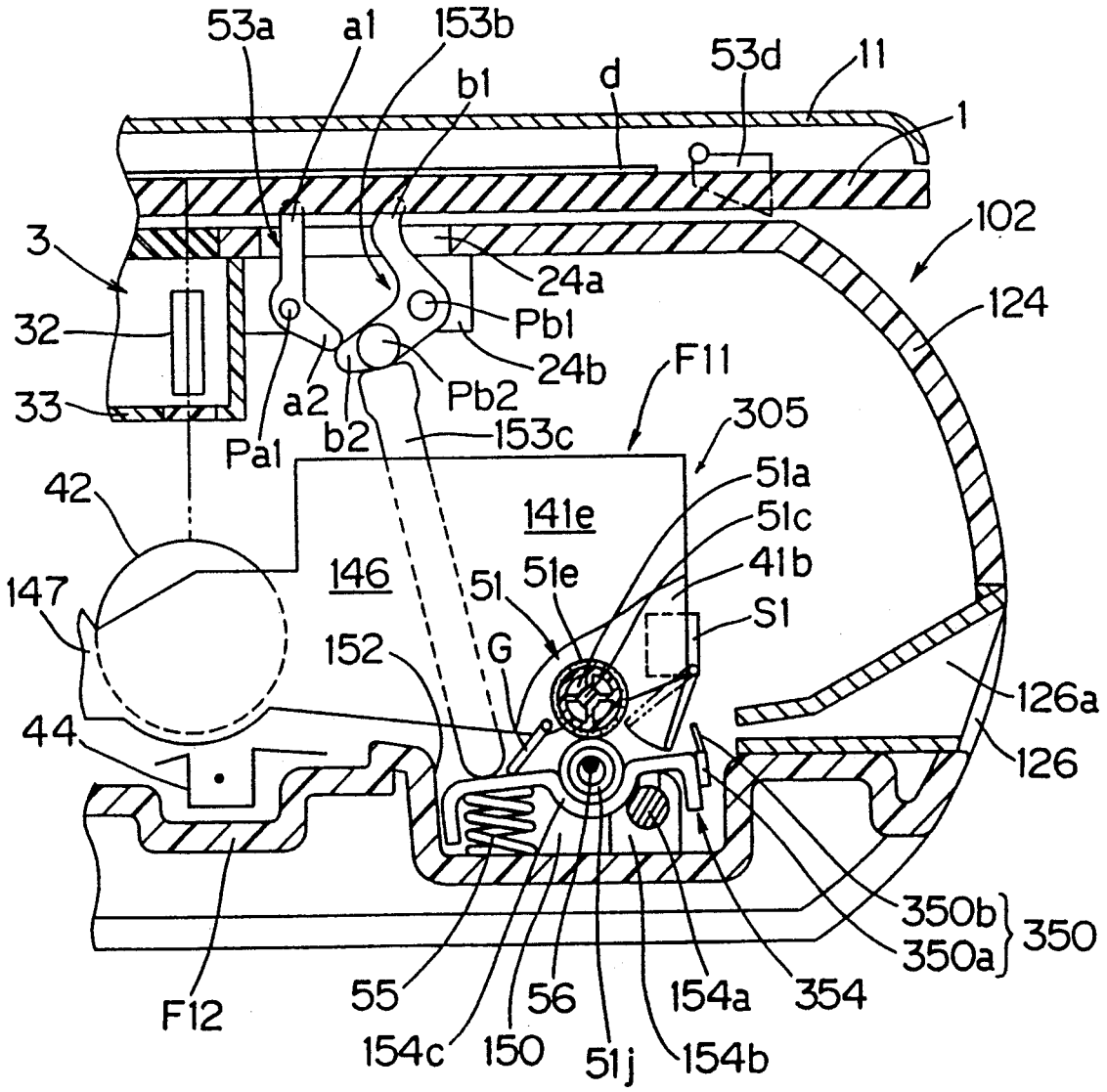
FIG. 17 is an enlarged section view of a main part of a copying machine as a sheet treatment apparatus according to a further embodiment of the present invention.

In FIG. 17 and the following, there is shown a sheet delivery mechanism 305 which adopts a sheet guide 354 having a microswitch 350 in place of the above-mentioned preventing member 250.

Microswitch

The microswitch 350, i.e., drive preventing means is provided on the upstream side of a microswitch S1 for detecting the presence of a sheet ST such that it can advance or retreat to or from a sheet delivery passage. The microswitch 350 includes a switch body 350*a* and a contact 350*b*. The contact 350*b* is provided on the top of the switch body 350*a* and serves to come in contact with the sheet ST to sense the insertion thereof. In addition, the contact 350*b* can be slanted in a sheet ST delivery direction according to the progress of the sheet ST relative to the switch body 350*a*.

Figure 18:
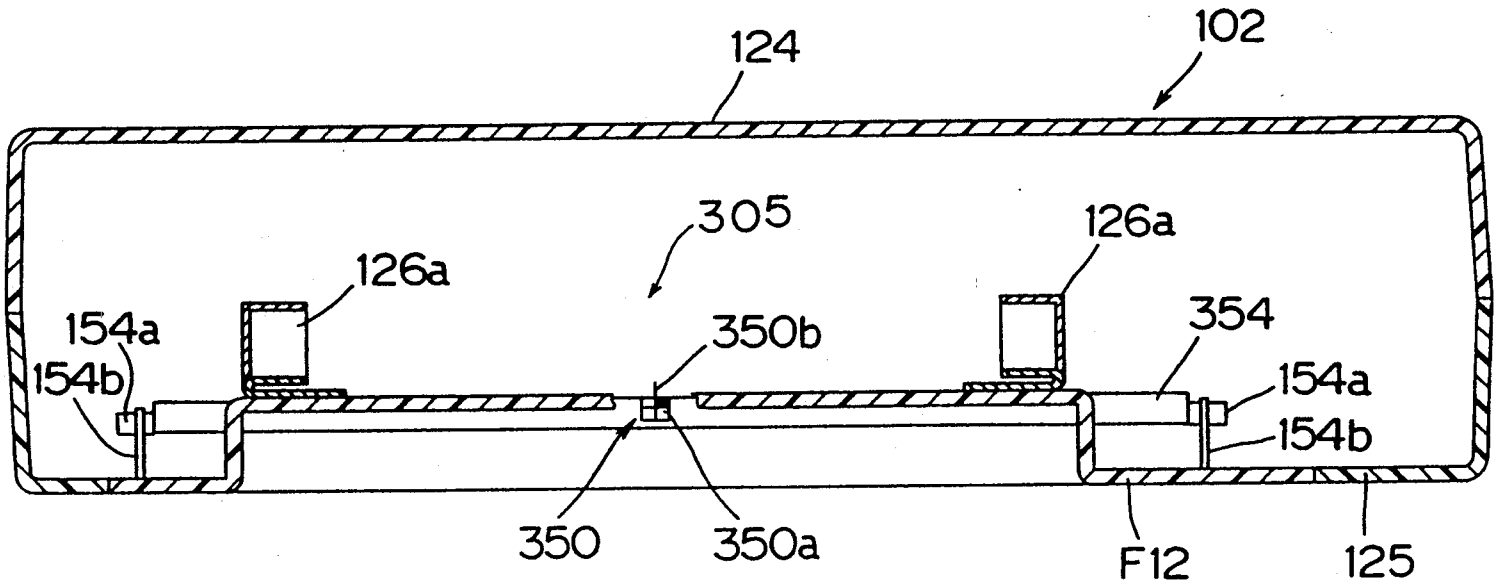
FIG. 18 is a lateral section view of the copying machine shown in FIG. 17 in a first state.

With reference to FIGS. 17 and 18, the microswitch 350 causes the contact 350*b* to project when the sheet guide 354 has a sheet halting attitude, so that the sheet ST inserted through a paper feeder 126 can be detected on this side of delivery rollers 51. Electrical equipment (not shown) of the present embodiment has the following structure. More specifically, in the case where the microswitches 350 and S1 simultaneously detect the sheet ST, the delivery rollers 51 are rotated and driven through all the steps of copy operation, i.e., while the tip of the sheet ST is inserted into the delivery rollers 51, halted and then fed.

Figure 19:
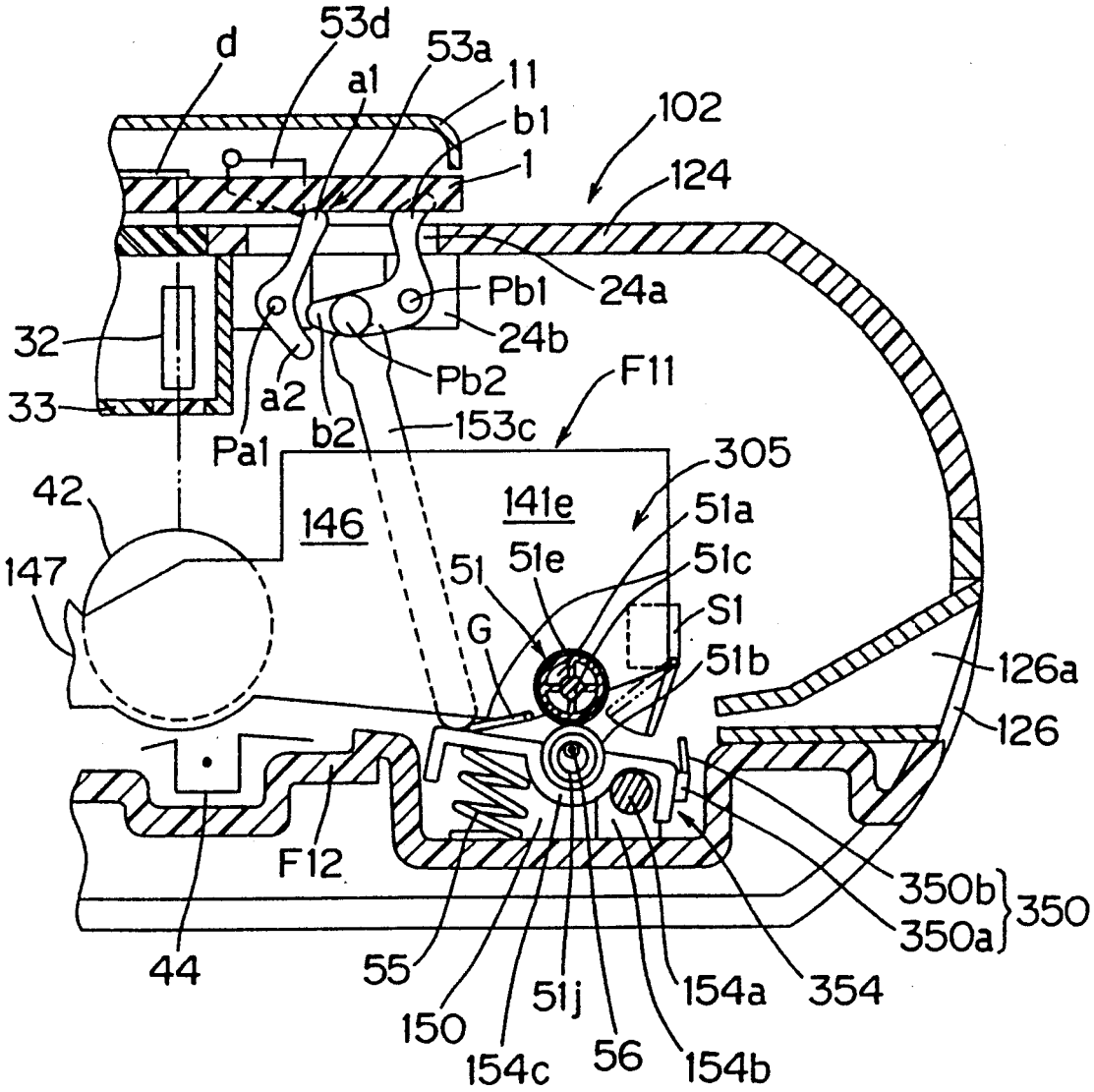
FIG. 19 is an enlarged section view of a main part of the copying machine shown in FIG. 17 in a second state.
Figure 20:
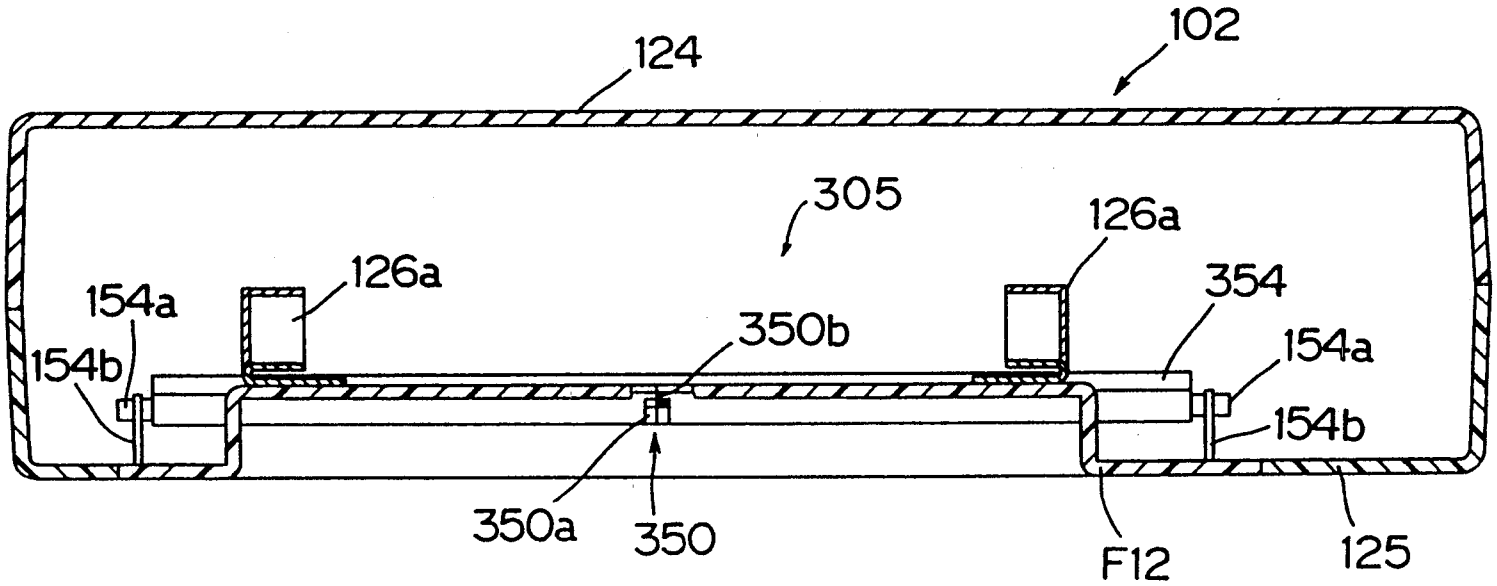
FIG. 20 is a lateral section view of the copying machine shown in FIG. 17 in the second state.

In the case where the sheet guide 354 has a delivery allowance attitude, the contact 350*b* is caused to retreat from a delivery passage so as not to come in contact with the sheet ST as shown in FIGS. 19 and 20. Consequently, the delivery rollers 51 are prevented from being driven irrespective of the detection signal of the microswitch S1.

Action of Fourth Embodiment

According to the above-mentioned structure, while a document table 1 is placed in a home position, i.e., the sheet guide 354 has the sheet halting attitude, the contact 350*b* projects into the sheet delivery passage as shown in FIGS. 17 and 18. Consequently, the microswitches S1 and 350 detect that the sheet ST is introduced into the body 102 through a manual guide 256*a* of the paper feeder 126. As a result, the delivery rollers 51 are driven through all the steps. Thus, normal copy operation can be carried out.

As shown in FIGS. 19 and 20, the contact 350*b* retreats from the sheet delivery passage. In the case where the document table 1 stops due to clogging or the like, the sheet ST is prevented from being delivered by the delivery rollers 51 irrespective of the detection signal of the microswitch S1 even if the copying machine is reactivated to insert the sheet ST therein in a state where the sheet guide 354 has the delivery allowance attitude, i.e., the document table 1 does not return to the home position.

Also in the present embodiment, if the document table 1 returns to the home position, and a cam mechanism 153 and the sheet guide 354 are reset to an idling condition, the copying machine can be reactivated. Consequently, it is possible to prevent copy errors from being caused by the poor synchronization of copy operation.

Other Variants

It is possible to add the following variants to the above-mentioned embodiments.

Leaf Spring

Figure 21:
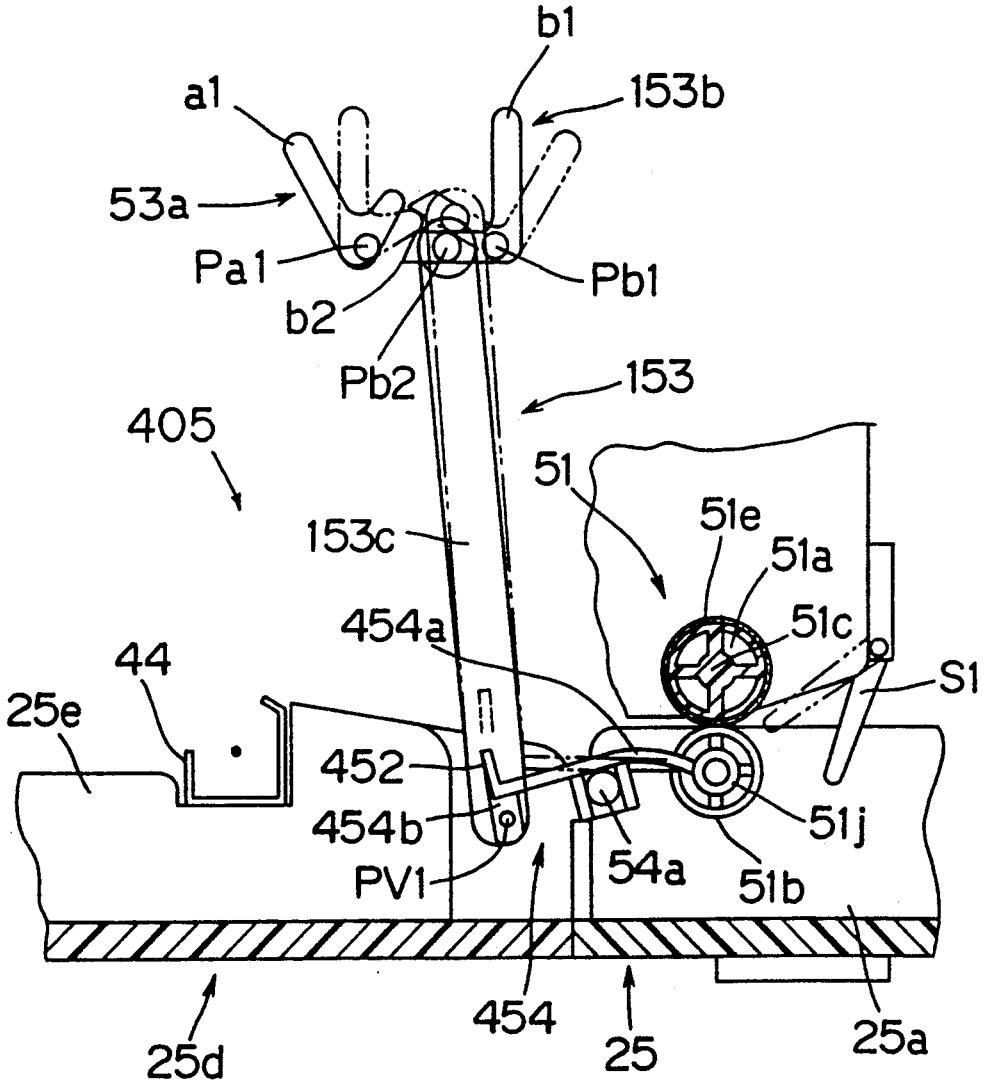
FIG. 21 is a schematic enlarged view of a main part according to a variant of the present invention.

In a sheet delivery mechanism 405 shown in FIG. 21, a sheet guide 454 as a supporting member having a leaf spring 454*a* may be applied to the sheet guide 54 of the first embodiment. The leaf spring 454*a* can be curved.

The sheet guide 454 causes its upstream end to be engaged with a small diameter cylinder 51*j* of a lower roller 51*b* so as to separably support the lower roller 51*b* relative to an upper roller 51*a*. A stopper click 452 as sheet halting means is integrally provided on the downstream end of the sheet guide 454.

In a first state shown by a two-dotted line in FIG. 21, the leaf spring 454*a* of the sheet guide 454 is slightly curved between the small diameter cylinder 51*j* and a supporting shaft 54*a*. Consequently, the leaf spring 454*a* forms first urging means with being slightly curved.

In a second state shown by a solid line in FIG. 21, the leaf spring 454*a* is further curved as compared with the first state. Consequently, the leaf spring 454*a* forms second urging means with being further curved.

To drive the sheet guide 454, a link 454*b* is also fixed to the free end side of the sheet guide 454. The link 454*b* is connected to a cam mechanism 153 as switching means through a supporting point PV1.

According to the present embodiment, the leaf spring 454*a* is elastically curved by the cam mechanism 153, so that the stopper click 452 of the sheet guide 454 can take a first state, i.e., a sheet halting attitude for halting the sheet (shown by a solid line in FIG. 21) and a second state, i.e., a delivery allowance attitude for allowing the sheet to be delivered (shown by a broken line in FIG. 21).

In case of the sheet halting attitude, pressure-welding between the lower and upper rollers 51*b* and 51*a* is reduced. In case of the delivery allowance attitude, the lower roller 51*b* is pressure-welded to the upper roller 51*a* by its own elastic force.

Accordingly, the sheet guide 454 can also serve as first and second urging means by adjusting urging force. In addition, the sheet guide 454 can also serve as position defining means. The position defining means is held in a non-operative condition in the first state, and held in an operative condition for applying pinching force to the delivery rollers 51 in the second state.

Also in the present embodiment, a sheet ST can surely be supplied to a photoreceptor drum 42 without a pair of auxiliary delivery rollers on the downstream side of the stopper lick 452. In addition, the leaf spring 454*a* of the sheet guide 454 is elastically curved to weld the lower roller 51*b* to the upper roller 51*a* by pressure. Consequently, a compression coil spring 55 for pressure-welding can be omitted. Thus, a structure can further be simplified.

The sheet guide 454 can be made of metal such as steel, hard resin or the like. In the case where the sheet guide 454 is made of resin, the thickness of the leaf spring 454*a* should be reduced such that desired elasticity can be obtained. A resin piece may be provided on the tip end of a metallic sheet guide 454 and may have a stopper click provided thereon, which are not shown.

Solenoid

Figure 22:
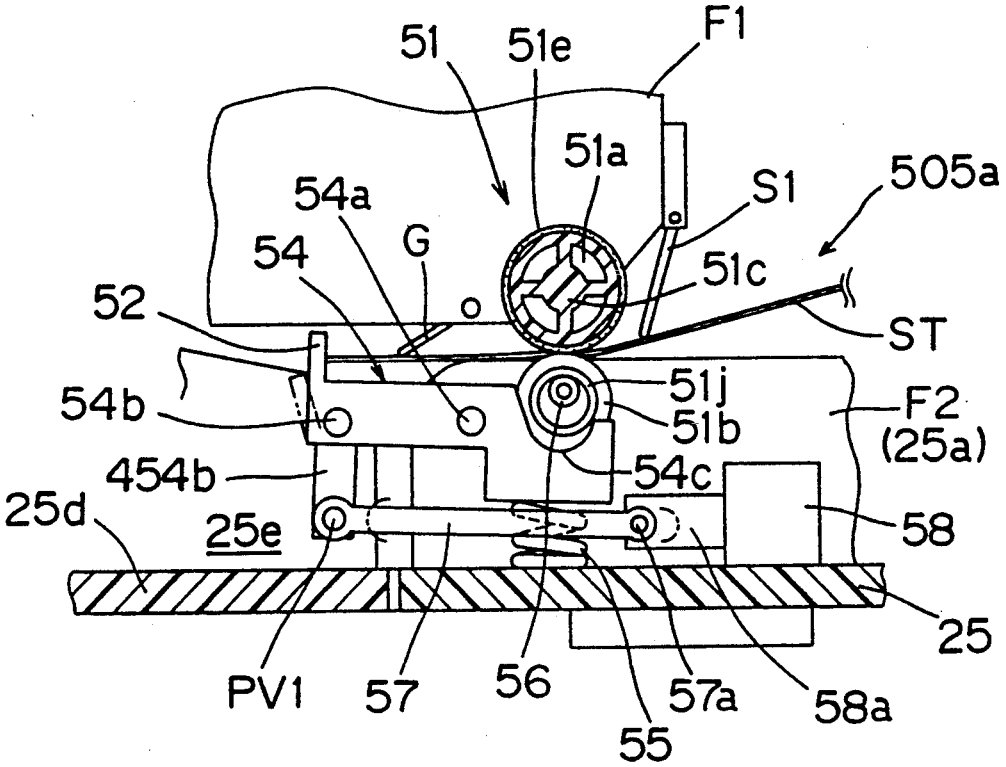
FIG. 22 is a schematic enlarged view of a main part according to another variant of the present invention.
Figure 23:
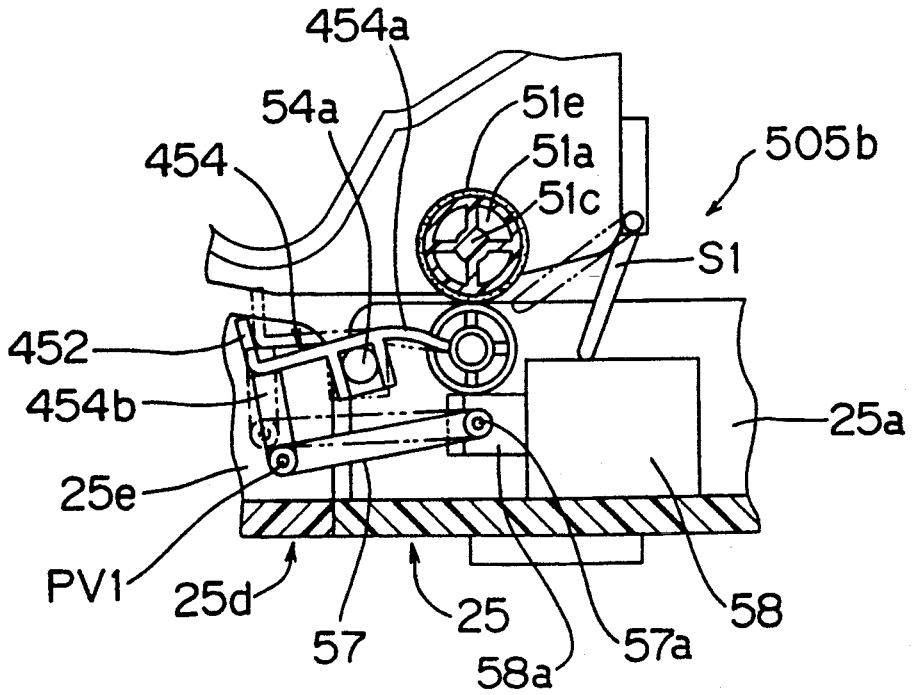
FIG. 23 is a schematic enlarged view of a main part according to yet another variant of the present invention.

FIGS. 22 and 23 show variants in which a solenoid mechanism 58 as switching means is provided.

FIG. 22 shows a sheet delivery mechanism 505*a* in which the sheet guide 54 of the first embodiment adopts the solenoid mechanism 58. The solenoid mechanism 58 includes a rod 58*a* which advances or retreats in the delivery direction of a sheet ST. An end of a link mechanism 57 is connected to a tip end of the rod 58*a* through a pin 57*a*. The other end of the link mechanism 57 is connected to a connecting member 454*b* through a supporting point PV1. The connecting member 454*b* is integrally formed on the downstream end of the sheet guide 54. When the rod 58*a* of the solenoid mechanism 58 is caused to advance or retreat interlockingly with a working member, i.e., a document table 11 (see FIG. 1)

or photoreceptor drum 42 (see FIG. 1), the sheet guide 54 can be switched into a first state, i.e., a sheet halting attitude and a second state, i.e., a delivery allowance attitude.

FIG. 23 shows a sheet delivery mechanism 505*b* in which the sheet guide 454 in FIG. 21 adopts a solenoid mechanism 58. According to an embodiment shown in FIG. 23, the other end of a link mechanism 57 is connected to a connecting member 454*b* through a supporting point PV1. The connecting member 454*b* is integrally formed on the downstream end of the sheet guide 454. When a rod 58*a* of the solenoid mechanism 58 is caused to advance or retreat interlockingly with a working member, i.e., a document table 11 (see FIG. 1) or photoreceptor drum 42 (see FIG. 1), the sheet guide 454 can be switched into a first state, i.e., a sheet halting attitude and a second state, i.e., a delivery allowance attitude.

Figure 24:
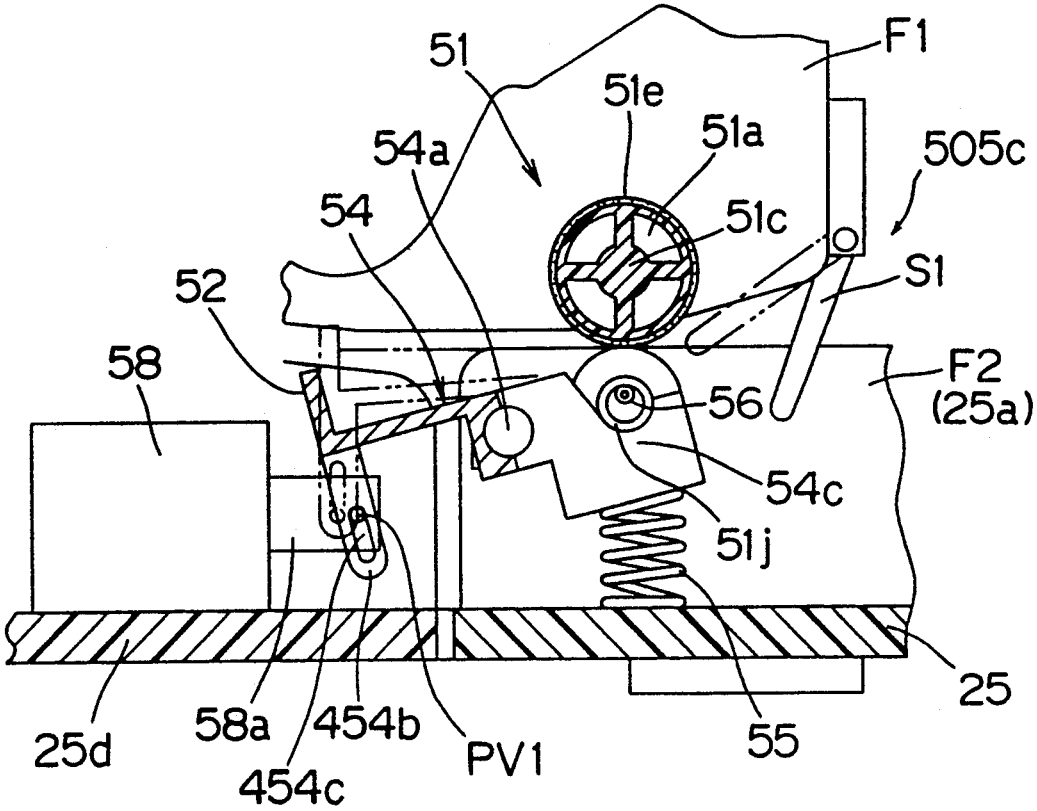
FIG. 24 is a schematic enlarged view of a main part according to an additional variant of the present invention.

FIG. 24 shows a sheet delivery mechanism 505*c* in which a solenoid mechanism 58 is provided opposite to that shown in FIG. 22. According to the present embodiment, a rod 58*a* is directly connected to a long hole 454*c* of a connecting member 454*b* through a supporting point PV1. The connecting member 454*b* is integrally provided on the downstream end of the sheet guide 54 according to the first embodiment.

Figure 25:
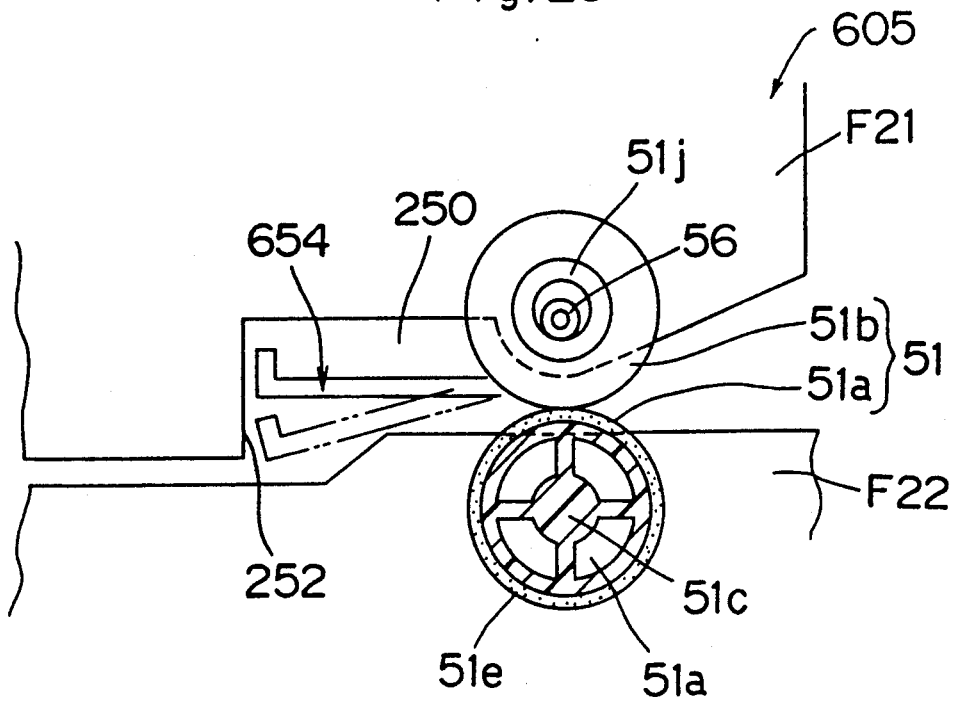
FIG. 25 is a schematic enlarged view of a main part according to a further variant of the present invention.
Figure 26:
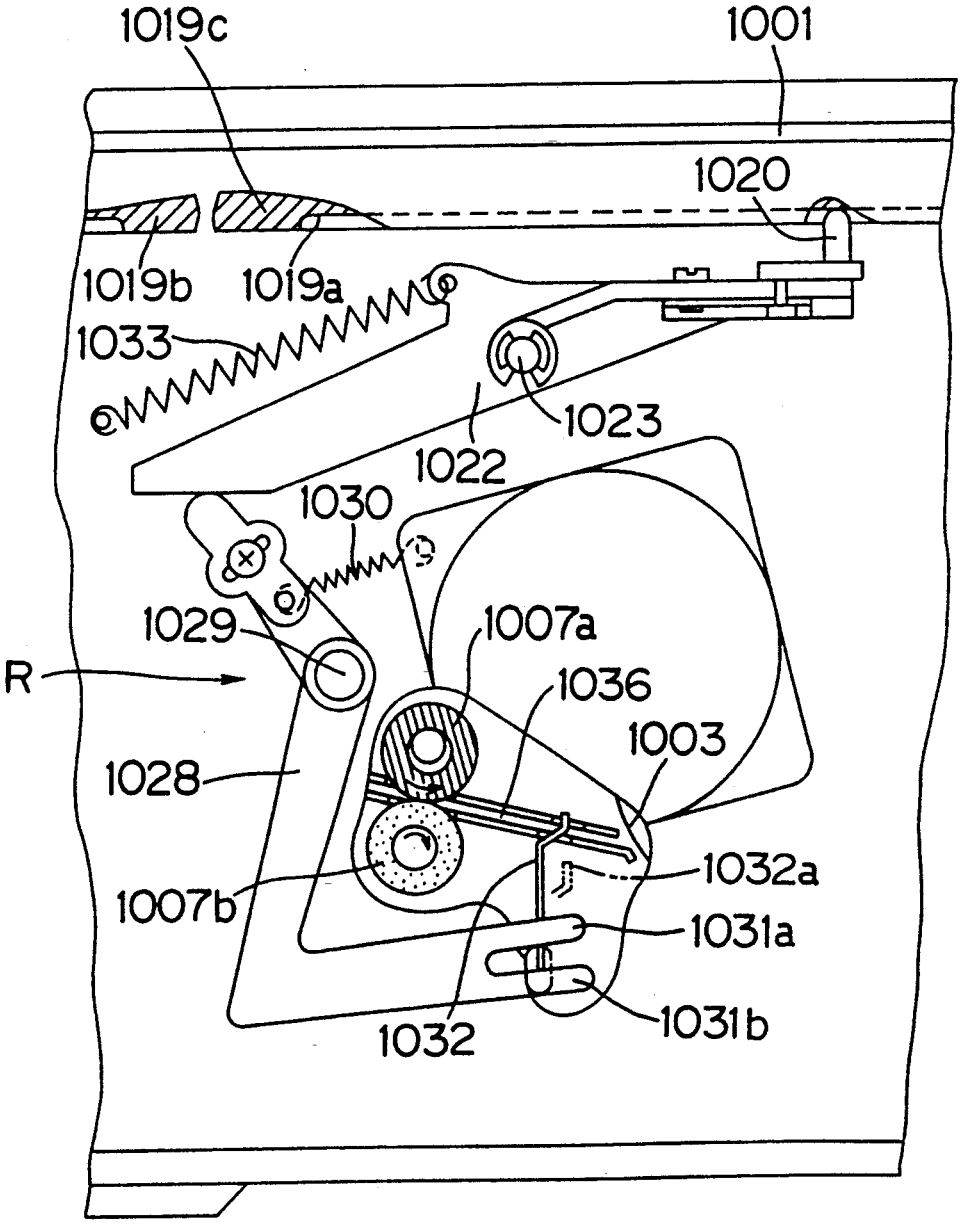
PRIOR ART Fig. 26
FIG. 26 is an enlarged section view of a main part according to the prior art.

In a sheet delivery mechanism 605 shown in FIG. 25, a dent 250 for dividing a stopper 252 may be provided on an upper passage forming member F21, and a sheet guide 654 may be housed in the dent 250. In this case, a drive roller 51*a* is provided on a lower passage forming member F22, and a driven roller 51*b* is provided on the upper passage forming member F21.

Thus, the present invention can variously be practiced without departing from its spirit or main features. Furthermore, while only the copying machine, i.e., image forming apparatus has been described in the above-mentioned embodiments, it is to be understood that the present invention can be applied to all the apparatuses which should automatically deliver a sheet, for example, an automated sheet hole punch and the like.

Accordingly, the above-mentioned embodiments are mere examples in every respect and should not be construed limitedly. It is to be understood that examples of a sheet include a pulp sheet, a cotton sheet and an OHP (Over-Head Projector) sheet made of plastic resin.

The scope of the present invention is defined by appended claims and not restricted by specification. It should be understood that various changes and modifications of the appended claims and equivalents may be made within the scope of the present invention.

What is claimed is:

1. A sheet delivery mechanism comprising:

(a) a pair of delivery rollers which include a drive roller and a roller driven with the drive roller to thereby hold a sheet therebetween such that one of said rollers can separate from the other roller and deliver the sheet along a sheet delivery passage of a sheet treatment apparatus for predeterminately treating the sheet;

(b) sheet halting means for halting the sheet by coming into contact with a tip of the sheet delivered by said delivery rollers; and (c) pinching force adjusting means for normally adjusting said delivery rollers into a first state where the sheet pinching force of said delivery rollers is relatively small so that said delivery rollers can slip on the halted sheet and into a second state where the sheet pinching force is relatively great so that the sheet can surely be delivered in the case where a halted sheet is released for delivery.

2. A sheet delivery mechanism according to claim 1, wherein said sheet treatment apparatus is an image forming apparatus including image forming means which develops an electrostatic latent image formed on a photoreceptor into a toner image and then transfers the toner image onto a sheet and said delivery rollers deliver the sheet to said photoreceptor.

3. A sheet delivery mechanism according to claim 2, wherein said image forming apparatus has an upper passage forming member which serves as a housing of the image forming means and forms the upper side of the sheet delivery passage, and a lower passage forming member which forms the lower side of said sheet delivery passage opposite to said upper passage forming member.

4. A sheet delivery mechanism according to claim 1, wherein said sheet halting means is integrally formed with said lower passage forming member forming the lower side of said sheet delivery passage.

5. A sheet delivery mechanism according to claim 4, wherein said lower passage forming member is attached to an apparatus body such that said sheet delivery passage can be opened.

6. A sheet delivery mechanism according to claim 1, wherein the other delivery roller is at least driven while the tip of the sheet is inserted in said delivery rollers, halted and then delivered.

7. A sheet delivery mechanism according to claim 1, wherein said pinching force adjusting means includes first urging means for always urging one of said delivery rollers to the other delivery roller in the first and second states, and second urging means for further urging said other delivery roller in the second state.

8. A sheet delivery mechanism according to claim 7, wherein said second urging means includes position defining means for defining the position of said delivery rollers in the second state, and drive means for driving said position defining means into a non-operative condition in the first state and into an operative condition in the second state.

9. A sheet delivery mechanism according to claim 8, wherein said drive means has spring means for urging said position defining means to the operative condition, and switching means for switching said position defining means into the non-operative condition against the urging force of said spring means in the first state and into the operative condition by the urging force of said spring means in the second state.

10. A sheet delivery mechanism according to claim 9, wherein said sheet treatment apparatus is an image forming apparatus including image forming means which develops an electrostatic latent image formed on a photoreceptor into a toner image and then transfers the toner image onto the sheet and a document table which reciprocally moves to guide a document image to said photoreceptor, said switching means is a cam mechanism which interlocks with said document table, and said delivery rollers deliver the sheet to said photoreceptor.

11. A sheet delivery mechanism according to claim 9, wherein said sheet treatment apparatus is an image forming apparatus including image forming means which develops an electrostatic latent image formed on a photoreceptor into a toner image and then transfers the toner image onto the sheet, said switching means is a solenoid mechanism which interlocks with the movement of said photoreceptor, and said delivery rollers deliver the sheet to said photoreceptor.

12. A sheet delivery mechanism according to claim 11, wherein said solenoid mechanism is connected to said position defining means through a link mechanism.

13. A sheet delivery mechanism according to claim 8, wherein said position defining means has integrally formed thereon a stopper click which forms said sheet halting means, and wherein said click enters the sheet delivery passage in the first state and retreats from said delivery passage in the second state.

14. A sheet delivery mechanism according to claim 8, wherein said sheet halting means is integrally formed with a lower passage forming member which forms the lower side of said sheet delivery passage.

15. A sheet delivery mechanism according to claim 8, wherein said position defining means serves as a sheet guide for guiding the sheet delivered by said delivery rollers.

16. A sheet delivery mechanism according to claim 15, wherein said sheet treatment apparatus has a working member which goes from an idling condition back to the idling condition during a predetermined sheet treating process;

said switching means has interlocking means for causing said sheet guide to interlock with said working member; and said sheet guide has drive preventing means for preventing said delivery rollers from being driven when said sheet treatment apparatus is reactivated in a state where said working member does not return to the idling condition.

17. A sheet delivery mechanism according to claim 16, wherein said working member of said sheet treatment apparatus is a document table of an image forming apparatus which reciprocally moves to scan a document.

18. A sheet delivery mechanism according to claim 16, wherein said drive preventing means includes a preventing member formed on the upstream end of said sheet guide in the sheet delivery direction for preventing the sheet from being supplied.

19. A sheet delivery mechanism according to claim 16, wherein said drive preventing means includes a microswitch attached to the upstream end of said sheet guide in the sheet delivery direction for detecting whether said sheet guide returns to a predetermined position.

20. A sheet delivery mechanism according to claim 7, wherein one of said delivery rollers is hollow, and the first urging means has a coil spring inserted into the inner portion of said roller.

21. A sheet delivery mechanism according to claim 7, wherein said pinching force adjusting means includes a supporting member having a leaf spring member which supports one of said rollers at one end and serves as first and second urging means by changing a bending state to adjust urging force.

22. A sheet delivery mechanism according to claim 21, wherein said supporting member is made of one piece resin material.

23. A sheet delivery mechanism according to claim 22, wherein said sheet halting means has a stopper click which is integrally formed on said supporting member, wherein said stopper click enters the sheet delivery passage in the first state and retreats from said delivery passage in the second state.

24. A sheet delivery mechanism according to claim 21, wherein said sheet treatment apparatus is an image forming apparatus including image forming means which develops an electrostatic latent image formed on a photoreceptor into a toner image and then transfers the toner image onto the sheet and a document table which reciprocally moves to guide a document image to said photoreceptor, said pinching force adjusting means has a cam mechanism which interlocks with said document table, and said delivery rollers deliver the sheet to said photoreceptor.

25. A sheet delivery mechanism according to claim 21, wherein said sheet treatment apparatus is an image forming apparatus including image forming means which develops an electrostatic latent image formed on a photoreceptor into a toner image and then transfers the toner image onto the sheet, said pinching force adjusting means has a solenoid mechanism which interlocks with said movement of the photoreceptor, and said delivery rollers deliver the sheet to said photoreceptor.

26. A sheet delivery mechanism comprising:

(a) a pair of delivery rollers for holding a sheet therebetween and introducing the sheet into a sheet delivery passage of a sheet treatment apparatus for predeterminately treating the sheet;

(b) a sheet guide for guiding the sheet delivered by said delivery rollers;

(c) supporting means for supporting said sheet guide such that said sheet guide can be switched between a halting position for preventing the sheet from being delivered and a delivery allowance position for allowing the sheet to be delivered;

(d) switching means for switching the positions of said sheet guide; and (e) sheet halting means for halting the sheet by coming into contact with a tip of the sheet guided by said sheet guide at the halting position, said sheet halting means being integrally formed on a passage forming member which forms a sheet delivery passage.

27. A sheet delivery mechanism according to claim 26, wherein said sheet treatment apparatus is an image forming apparatus including image forming means which develops an electrostatic latent image formed on a photoreceptor into a toner image and then transfers the toner image onto a sheet, and said delivery rollers deliver the sheet to said photoreceptor.

28. A sheet delivery mechanism according to claim 27, wherein said sheet halting means is an inner sideward surface of a dent formed in an upper passage forming member forming the upper side of the sheet delivery passage and serving as a housing of said image forming means.

29. A sheet delivery mechanism according to claim 27, wherein said image forming apparatus has a document table which reciprocally moves to guide a document image to a photoreceptor, and said switching means has a cam mechanism which interlocks with said document table.

30. A sheet delivery mechanism according to claim 27, wherein said switching means is a solenoid mechanism which interlocks with the movement of said photoreceptor.

31. A sheet delivery mechanism according to claim 26, wherein said sheet halting means is an inner sideward surface of a dent formed in a lower passage forming member forming the lower side of said sheet delivery passage.

32. A sheet delivery mechanism according to claim 31, wherein said lower passage forming member is attached to an apparatus body such that said sheet delivery passage can be opened.

33. A sheet delivery mechanism according to claim 26, wherein said sheet treatment apparatus has a working member which goes from an idling condition back to the idling condition during a predetermined sheet treating process;

said switching means has interlocking means for causing said sheet guide to interlock with said working member; and said sheet guide has drive preventing means for preventing said delivery rollers from being driven when said sheet treatment apparatus is reactivated in a state where said working member does not return to the idling condition.

34. A sheet delivery mechanism according to claim 33, wherein said drive preventing means includes a preventing member formed on the upstream end of said sheet guide in the sheet delivery direction for preventing a sheet from being supplied.

35. A sheet delivery mechanism according to claim 33, wherein said drive preventing means includes a microswitch attached to the upstream end of said sheet guide in the sheet delivery direction for detecting whether said sheet guide returns to a predetermined attitude.

36. A sheet delivery mechanism comprising;

a working member which has an idling condition and moving condition, said working member being operable to assume the moving condition after being in the idling condition, and then to return to the idling condition during a predetermined sheet treating process;

a pair of delivery rollers for holding a sheet therebetween and delivering the sheet to a sheet delivery passage of a sheet treatment apparatus to predeterminately treat the sheet a sheet guide for guiding the sheet delivered by said delivery rollers;

supporting means for supporting said sheet guide such that said sheet guide can be switched between a halting position for preventing the sheet from being delivered and a delivery allowance position for allowing the sheet to be delivered;

switching means for switching the positions of said sheet guide by means of interlocking means included therein, said interlocking means causing said sheet guide to interlock with said working member; and drive preventing means provided on said sheet guide for preventing said delivery rollers form being driven when said sheet treatment apparatus is reactivated in a state where said working member does not return to the idling condition.

37. A sheet delivery mechanism according to claim 36, wherein said working member of said sheet treatment apparatus is a document table of an image forming apparatus which reciprocally moves to scan a document.

38. A sheet delivery mechanism according to claim 36, wherein said drive preventing means includes a preventing member formed on the upstream end of said sheet guide in the sheet delivery direction for preventing a sheet from being supplied.

39. A sheet delivery mechanism according to claim 36, wherein said drive preventing means includes a microswitch attached to the upstream end of said sheet guide in the sheet delivery direction for detecting whether said sheet guide returns to a predetermined position.

40. A sheet delivery mechanism according to claim 36, wherein said interlocking means is a cam mechanism for interlocking with said working member.

41. A sheet delivery mechanism according to claim 36, wherein said interlocking means is a solenoid mechanism for interlocking with said working member.

* * * * *